US008988320B2

(12) United States Patent
Yamashita et al.

(10) Patent No.: US 8,988,320 B2
(45) Date of Patent: Mar. 24, 2015

(54) DISPLAY DEVICE, DRIVING METHOD THEREOF, AND ELECTRONIC DEVICE

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1658 days.

(21) Appl. No.: 12/149,452

(22) Filed: May 1, 2008

(65) Prior Publication Data

US 2008/0291182 A1 Nov. 27, 2008

(30) Foreign Application Priority Data

May 21, 2007 (JP) ..... 2007-133864

(51) Int. Cl.
*G09G 3/30* (2006.01)
*G09G 3/32* (2006.01)

(52) U.S. Cl.
CPC ..... *G09G 3/3233* (2013.01); *G09G 2300/0426* (2013.01); *G09G 2300/0439* (2013.01); *G09G 2300/0443* (2013.01); *G09G 2300/0814* (2013.01); *G09G 2300/0819* (2013.01); *G09G 2300/0852* (2013.01); *G09G 2320/043* (2013.01)
USPC ..... 345/76

(58) Field of Classification Search
USPC ..... 345/76–82
See application file for complete search history.

(56) References Cited

U.S. PATENT DOCUMENTS

| | | | | |
|---|---|---|---|---|
| 2004/0196223 | A1* | 10/2004 | Kwon | 345/82 |
| 2005/0083270 | A1* | 4/2005 | Miyazawa | 345/76 |
| 2006/0066531 | A1* | 3/2006 | Park et al. | 345/76 |
| 2006/0170628 | A1* | 8/2006 | Yamashita et al. | 345/76 |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2005-148704 | A | 6/2005 |
| JP | 2005-151015 | A | 6/2005 |
| JP | 2006-502433 | A | 1/2006 |
| JP | 2006-215213 | | 8/2006 |
| JP | 2008-529083 | A | 7/2008 |

OTHER PUBLICATIONS

Japanese Office Action issued Apr. 3, 2012 for corresponding Japanese Application No. 2007-133864.

* cited by examiner

*Primary Examiner* — Dennis Joseph
(74) *Attorney, Agent, or Firm* — Rader, Fishman & Grauer PLLC

(57) ABSTRACT

Disclosed herein is a display device including: a pixel array unit; and a driving unit; wherein said pixel array unit includes first scanning lines and second scanning lines in a form of rows, signal lines in a form of columns, and pixels in a form of a matrix, each pixel includes a drive transistor, a sampling transistor, a switching transistor, a retaining capacitance, and a light emitting element, said driving unit includes a write scanner for sequentially supplying a control signal to each first scanning line, a drive scanner for sequentially supplying a control signal to each second scanning line, and a signal selector for alternately supplying a signal potential as a video signal and a predetermined reference potential to each signal line.

19 Claims, 18 Drawing Sheets

DISPLAY DEVICE, DRIVING METHOD THEREOF, AND ELECTRONIC DEVICE

CROSS REFERENCES TO RELATED APPLICATIONS

The present invention contains subject matter related to Japanese Patent Application JP 2007-133864 filed in the Japan Patent Office on May 21, 2007, the entire contents of which are incorporated herein by reference.

BACKGROUND OF THE INVENTION

1. Field of the Invention

The present invention relates to an active matrix type display device using a light emitting element in a pixel, a driving method thereof, and an electronic device including this kind of display device.

2. Description of the Related Art

A display device, for example, a liquid crystal display, has a large number of liquid crystal pixels arranged in the form of a matrix, and displays an image by controlling the transmission intensity or reflection intensity of incident light in each pixel according to image information to be displayed. This is true for an organic EL display or the like using an organic EL element in a pixel. However, unlike the liquid crystal pixel, the organic EL element is a self-luminous element. The organic EL display has advantages of high image visibility, no need for a backlight, high response speed, and the like as compared with the liquid crystal display. In addition, the luminance level (gradation) of each light emitting element can be controlled by the value of a current flowing through the light emitting element. The organic EL display differs greatly from a voltage control type, such as the liquid crystal display or the like, in that the organic EL display is of a so-called current control type.

As with the liquid crystal display, these is a simple matrix system and an active matrix system as a driving system of the organic EL display. The former system offers a simple structure, but presents, for example, the problem of difficulty in realizing a large and high definition display. Therefore, the active matrix system is now being actively developed. This system controls a current flowing through a light emitting element within each pixel circuit by an active element (typically a thin-film transistor (TFT)) provided within the pixel circuit. The active matrix system is described in Japanese Patent Laid-Open No. 2003-255856, Japanese Patent Laid-Open No. 2003-271095, Japanese Patent Laid-Open No. 2004-133240, Japanese Patent Laid-Open No. 2004-029791, Japanese Patent Laid-Open No. 2004-093682, and Japanese Patent Laid-Open No. 2006-215213.

SUMMARY OF THE INVENTION

Pixel circuits of the past are disposed at respective parts where scanning lines in the form of rows, where scanning lines supply a control signal, and signal lines in the form of columns where signal lines supply a video signal, intersect each other. Each of the pixel circuits of the past includes at least a sampling transistor, a retaining capacitance, a drive transistor, and a light emitting element. The sampling transistor conducts according to a control signal supplied from a scanning line to sample a video signal supplied from a signal line. The retaining capacitance retains an input voltage corresponding to the signal potential of the sampled video signal. The drive transistor supplies an output current as a driving current during a predetermined emission period according to the input voltage retained by the retaining capacitance. Incidentally, the output current generally has a dependence on the carrier mobility of a channel region in the drive transistor and the threshold voltage of the drive transistor. The light emitting element emits light at a luminance corresponding to the video signal on the basis of the output current supplied from the drive transistor.

The drive transistor receives the input voltage retained by the retaining capacitance at the gate of the drive transistor, makes the output current flow between the source and the drain of the drive transistor, and thus passes the current through the light emitting element. The luminance of the light emitting element is generally proportional to the amount of the current passed through the light emitting element. Further, the amount of the output current supplied by the drive transistor is controlled by gate voltage, that is, the input voltage written to the retaining capacitance. The pixel circuit in the past controls the amount of current supplied to the light emitting element by changing the input voltage applied to the gate of the drive transistor according to the input video signal.

The operation characteristic of the drive transistor is expressed by the following Equation 1:

$$Ids=(1/2)\mu(W/L)Cox(Vgs-Vth)^2 \quad \text{Equation 1}$$

In this Transistor Characteristic Equation 1, Ids denotes a drain current flowing between the source and the drain, and is the output current supplied to the light emitting element in the pixel circuit. Vgs denotes a gate voltage applied to the gate with the source as a reference, and is the above-described input voltage in the pixel circuit. Vth denotes the threshold voltage of the transistor. μ denotes the mobility of a semiconductor thin film forming a channel in the transistor. W denotes a channel width. L denotes a channel length. Cox denotes a gate capacitance. As is clear from this Transistor Characteristic Equation 1, when the thin-film transistor operates in a saturation region and the gate voltage Vgs becomes higher than the threshold voltage Vth, the thin-film transistor is brought into an on state, and thus the drain current Ids flows. In theory, as indicated by the above Transistor Characteristic Equation 1, when the gate voltage Vgs is constant, the same amount of drain current Ids is always supplied to the light emitting element. Thus, when video signals all having the same level are supplied to respective pixels forming a screen, all the pixels will emit light at the same luminance so that uniformity of the screen can be obtained.

In practice, however, individual device characteristics of thin film transistors (TFTs) formed with a semiconductor thin film of polysilicon or the like are varied. The threshold voltage Vth, in particular, is not constant, but is varied in each pixel. As is clear from the above-described Transistor Characteristic Equation 1, when the threshold voltage Vth of each drive transistor is varied, even when the gate voltage Vgs is constant, the drain current Ids is varied and the luminance is varied in each pixel, thus impairing the uniformity of the screen. A pixel circuit incorporating a function of cancelling a variation in the threshold voltage of the drive transistor has been developed in the past, and is disclosed in the above-mentioned Japanese Patent Laid-Open No. 2004-133240, for example.

However, the threshold voltage Vth of the drive transistor is not the only factor in variations in the output current supplied to the light emitting element. As is clear from the above-described Transistor Characteristic Equation 1, the output current Ids also changes when the mobility μ of the drive transistor varies. As a result, the uniformity of the screen is impaired. A pixel circuit incorporating a function of cancelling a variation in the mobility of the drive transistor has been developed in the past, and is disclosed in the above-mentioned Japanese Patent Laid-Open No. 2006-215213, for example.

The pixel circuits of the past demand a transistor other than the drive transistor to be formed within the pixel circuits in order to implement the threshold voltage correcting function and the mobility correcting function described above. For a higher definition of pixels, it is better to minimize the number of transistor elements forming a pixel circuit. When the number of transistor elements is limited to two, that is, a drive transistor and a sampling transistor for sampling a video signal, for example, the power supply voltage supplied to pixels needs to be pulsed in order to implement the threshold voltage correcting function and the mobility correcting function described above.

In this case, a power supply scanner is demanded to apply pulsed power supply voltage (power supply pulse) to each pixel sequentially. For the power supply scanner to supply driving current to each pixel stably, an output buffer of the power supply scanner needs to be of a large size. The power supply scanner therefore demands a large area. When the power supply scanner is formed integrally with a pixel array unit on a panel, the layout area of the power supply scanner is large, thus limiting the effective screen size of the display device. In addition, because the power supply scanner continues supplying the driving current to each pixel during most of the time of line-sequential scanning, the transistor characteristics of the output buffer are degraded sharply, and thus reliability in long-term use may not be obtained.

In view of the problems of the existing techniques described above, it is desirable to provide a display device that makes it possible to fix the power supply voltage while retaining the threshold voltage correcting function and the mobility correcting function of pixels. According to an embodiment of the present invention, there is provided a display device including: a pixel array unit; and a driving unit; wherein the pixel array unit includes first scanning lines and second scanning lines in the form of rows, signal lines in the form of columns, and pixels in the form of a matrix, the pixels being disposed at parts where the first scanning lines and the signal lines intersect each other, each pixel includes a drive transistor, a sampling transistor, a switching transistor, a retaining capacitance, and a light emitting element. The drive transistor is of a P-channel type, has a control terminal as a gate and a pair of current terminals as a source and a drain, a control terminal of the sampling transistor connected to a first scanning line, a pair of current terminals of the sampling transistor connected between the signal line and the gate of the drive transistor, a control terminal of the switching transistor is connected to a second scanning line, and one of the pair of current terminals of the switching transistor connected to the source of the drive transistor while the other of the pair of current terminals of the switching transistor is connected to a power supply line. The retaining capacitance is connected between the gate and the source of the drive transistor, the light emitting element is connected between the drain of the drive transistor and a grounding line, the driving unit includes a write scanner for sequentially supplying a control signal to each first scanning line, a drive scanner for sequentially supplying a control signal to each second scanning line, and a signal selector for alternately supplying a signal potential as a video signal and a predetermined reference potential to each signal line. The write scanner outputs the control signal to the first scanning line to drive the pixel when the signal line is at the reference potential, whereby an operation of correcting for threshold voltage of the drive transistor is performed. The write scanner also outputs the control signal to the first scanning line to drive the pixel when the signal line is at the signal potential, whereby a writing operation of writing the signal potential to the retaining capacitance is performed. The drive scanner outputs the control signal to the second scanning line to send current through the pixel after the signal potential is written to the retaining capacitance, whereby a light emitting operation of the light emitting element is performed.

Preferably, the sampling transistor and the switching transistor are also of the P-channel type, and the transistors forming the pixel are all of the P-channel type. In addition, the write scanner outputs the control signal to the first scanning line to drive the pixel when the signal line is at the signal potential, whereby the writing of the signal potential to the retaining capacitance and a correcting operation of correcting a variation in mobility of the drive transistor is performed simultaneously.

Each pixel in the display device according to the above-described embodiment of the present invention includes a drive transistor, a sampling transistor, a retaining capacitance, and a light emitting element. In the above-described embodiment of the present invention, a switching transistor is added to the pixel, and a P-channel type transistor is used as the drive transistor. By thus forming the pixel circuit with the three transistors and using a P-channel type transistor as the drive transistor, it is possible to fix the power supply voltage supplied to each pixel. The power fixation eliminates the need for a power supply scanner, and it can provide a margin for the layout area of the screen. Although another scanner is necessary to perform the line-sequential driving of the switching transistor added to each pixel, this scanner does not need to supply a power supply pulse. Therefore, a large output buffer is not demanded, and the layout area is relatively small. Unlike a power supply scanner, an ordinary scanner for supplying a gate pulse for controlling the switching transistor is degraded to a small degree, and is thus highly reliable. By thus doing away with the power supply scanner that has been demanded in the past, it is possible to increase the layout area of the pixel array unit and improve the reliability of the peripheral driving unit. At the same time, by using a P-channel type transistor as the drive transistor, it is possible to reduce an error in the mobility correcting operation, and thus obtaining high uniformity.

DETAILED DESCRIPTION OF THE PREFERRED EMBODIMENTS

Figure 1:
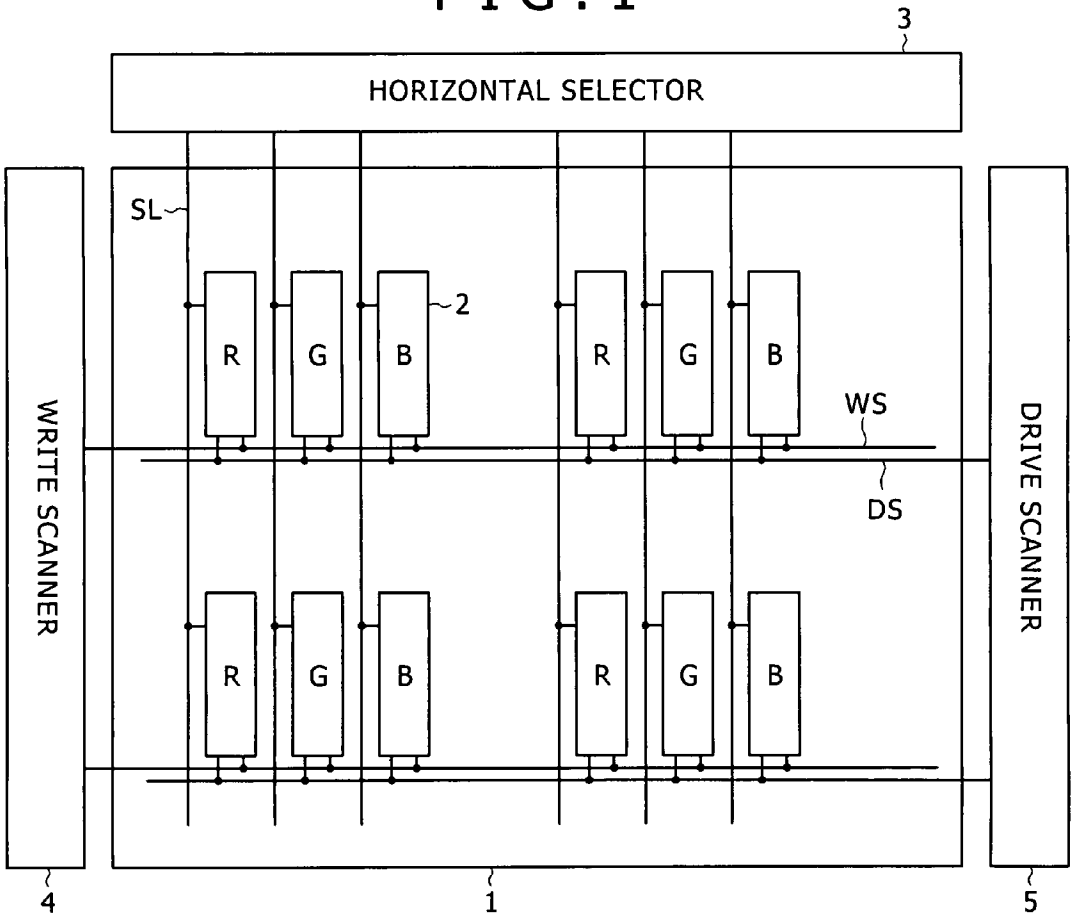
FIG. 1 is a block diagram showing a general configuration of a display device according to a first embodiment of the present invention.

Preferred embodiments of the present invention will be described in detail with reference to the drawings hereinafter. FIG. 1 is a block diagram showing a general configuration of a display device according to a first embodiment of the present invention. As shown in FIG. 1, the display device includes a pixel array unit 1 and a driving unit for driving the pixel array unit 1. The pixel array unit 1 includes first scanning lines WS in the form of rows, second scanning lines DS similarly in the form of rows, signal lines SL in the form of columns, and pixels 2 in the form of a matrix, which pixels are disposed at parts where the scanning lines WS and the signal lines SL intersect each other. Incidentally, in the present example, one of three RGB primary colors is assigned to each of the pixels 2, thus enabling a color display. However, the display device is not limited to this, and it includes a monochrome display panel. The driving unit includes: a write scanner 4 for performing line-sequential driving of the pixels 2 in row units by sequentially supplying a control signal to the respective scanning lines WS; a drive scanner 5 for sequentially supplying a control signal to the other scanning lines DS according to the line-sequential driving to make the pixels 2 perform a predetermined correcting operation; and a horizontal selector (signal selector) 3 for supplying a signal potential as a video signal and a reference potential to the signal lines SL in the form of columns according to the line-sequential driving.

Figure 2:
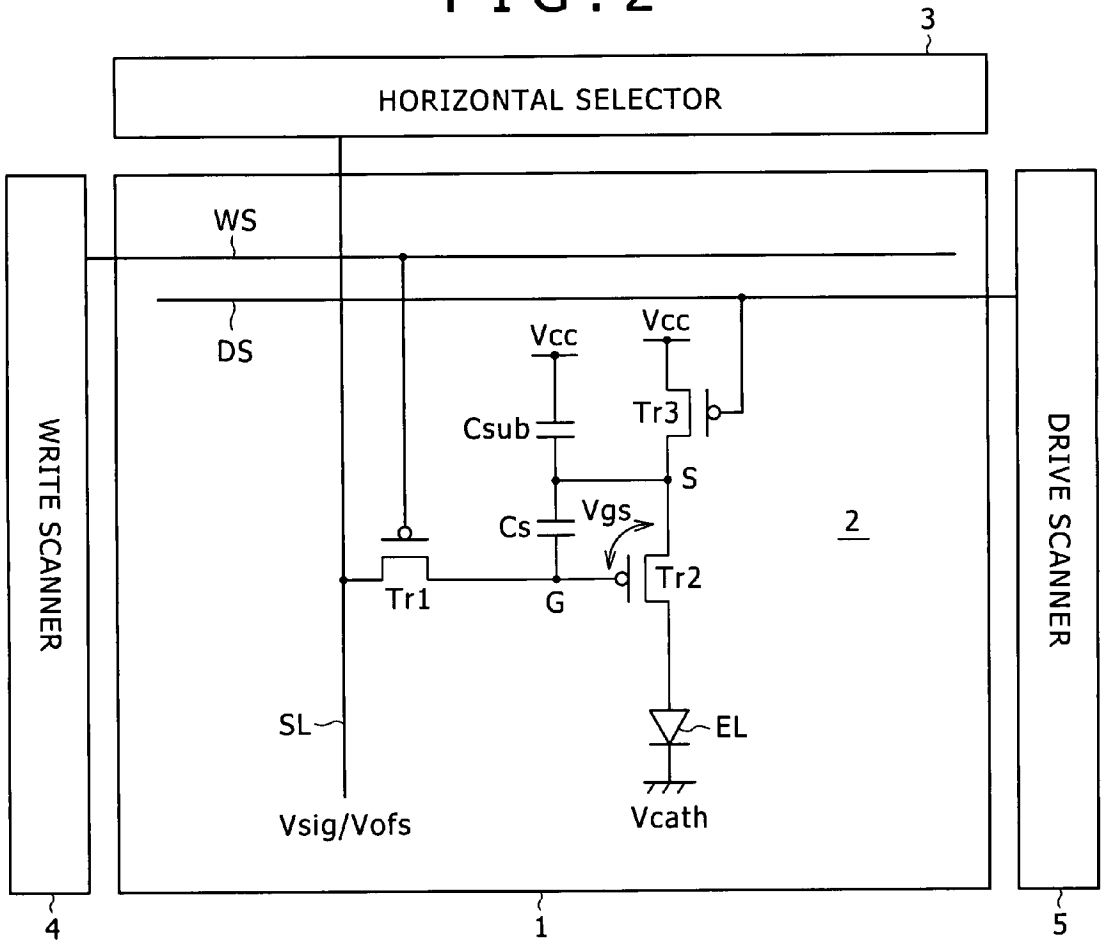
FIG. 2 is a circuit diagram showing a concrete configuration of the display device shown in FIG. 1.

FIG. 2 is a circuit diagram showing a concrete configuration and connection relation of a pixel 2 included in the display device shown in FIG. 1. As shown in FIG. 2, the pixel 2 includes a light emitting element EL typified by an organic EL device or the like, a sampling transistor Tr1, a drive transistor Tr2, a switching transistor Tr3, a retaining capacitance Cs, and an auxiliary capacitance Csub. The drive transistor Tr2 is of a P-channel type, and has a control terminal serving as a gate G and a pair of current terminals serving as a source S and a drain. The sampling transistor Tr1 has a control terminal thereof connected to a first scanning line WS, and has a pair of current terminals thereof connected between a signal line SL and the gate G of the drive transistor Tr2. As described above, a signal potential Vsig as a video signal and a predetermined reference potential Vofs are supplied from the horizontal selector 3 to the signal line SL such that the signal potential Vsig alternates with the reference potential Vofs. The switching transistor Tr3 has a gate connected to a second scanning line DS, and has a pair of current terminals, one of which is connected to the source S of the drive transistor Tr2 and the other of which is connected to a power supply line Vcc. It is to be noted that this power supply line Vcc has a fixed voltage. The retaining capacitance Cs is connected between the gate G and the source S of the drive transistor Tr2. The auxiliary capacitance Csub has one terminal connected to the fixed voltage Vcc and another terminal connected to the retaining capacitance Cs. The light emitting element EL is connected between the drain of the drive transistor Tr2 and a grounding line. In other words, the diode type light emitting element EL has an anode connected to the drain of the drive transistor Tr2 and a cathode connected to the grounding line. The grounding line is supplied with a predetermined cathode voltage Vcath.

In the pixel 2 shown in FIG. 2, the drive transistor Tr2 is of the P-channel type. The other transistors, that is, the sampling transistor Tr1 and the switching transistor Tr3, may be of an N-channel type or the P-channel type. In the embodiment of FIG. 2, the sampling transistor Tr1 and the switching transistor Tr3 are both of the P-channel type, and thus the transistors forming the pixel 2 are all P-channel type transistors.

As described above, the driving unit includes: the write scanner 4 for sequentially supplying a control signal to the first scanning line WS; the drive scanner 5 for sequentially supplying a control signal to each second scanning line DS; and the signal selector 3 for alternately supplying the signal potential Vsig as the video signal and the predetermined reference potential Vofs to each signal line SL.

In such a configuration, the write scanner 4 outputs a control signal to the first scanning line WS to drive the pixel 2 when the signal line SL is at the reference potential Vofs, whereby an operation of correcting the threshold voltage Vth of the drive transistor Tr2 is performed. Further, the write scanner 4 outputs a control signal to the first scanning line WS to drive the pixel 2 when the signal line SL is at the signal potential Vsig, whereby a writing operation of writing the signal potential Vsig to the retaining capacitance Cs is performed. After the signal potential Vsig is written to the retaining capacitance Cs, the drive scanner 5 outputs a control signal to the second scanning line DS to pass a current through the pixel 2, so that a light emitting operation of the light emitting element EL is performed. The write scanner 4 outputs a control signal to the first scanning line WS to drive the pixel 2 when the signal line SL is at the signal potential Vsig, whereby the signal potential Vsig is written to the retaining capacitance Cs, and the write scanner 4 simultaneously performs a correcting operation of correcting a variation in mobility μ of the drive transistor Tr2.

Figure 3:
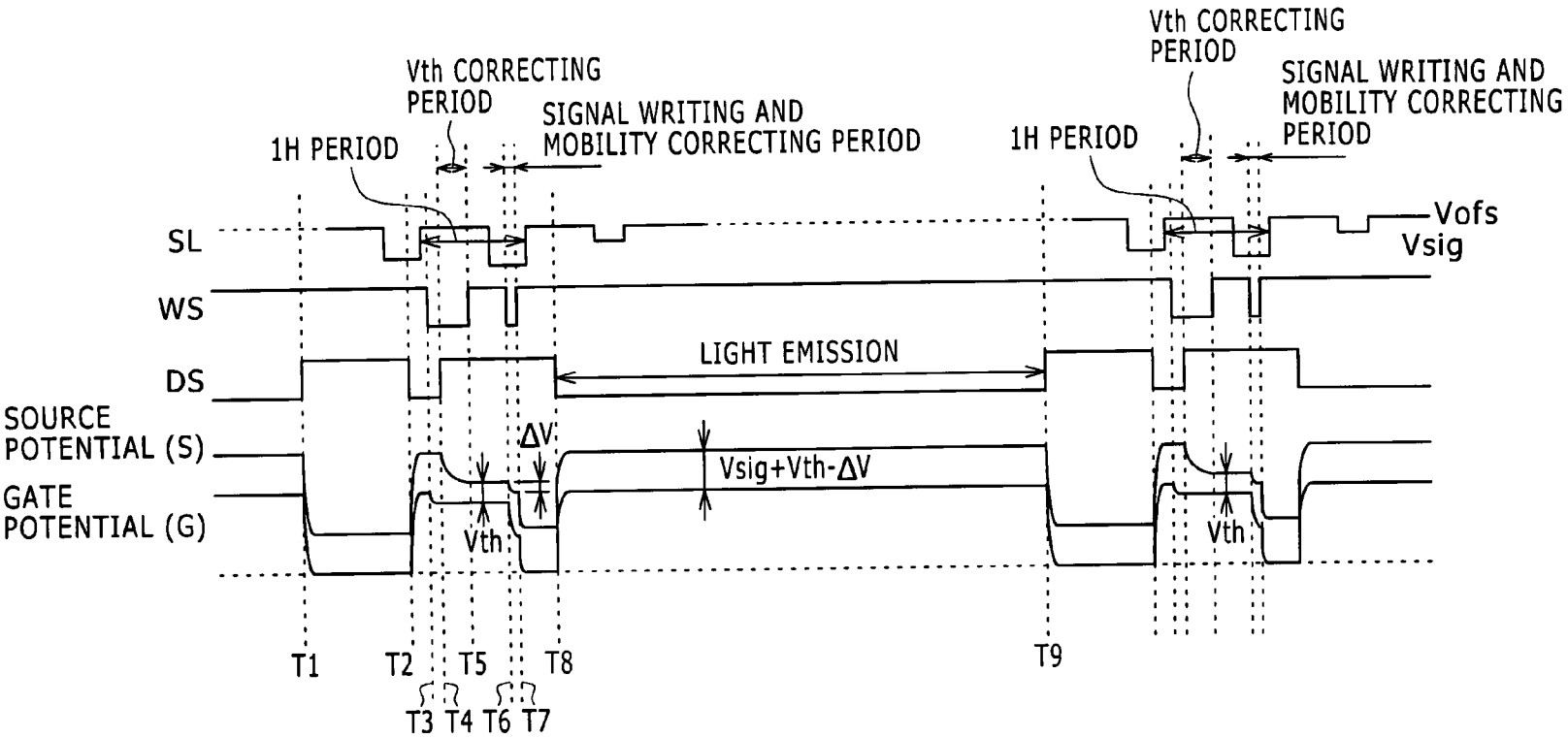
FIG. 3 is a timing chart of assistance in explaining an operation of the first embodiment of the display device shown in FIG. 2.

FIG. 3 is a timing chart of assistance in explaining the operation of the pixel 2 shown in FIG. 2. This timing chart shows the waveforms of the control signals applied to the respective scanning lines WS and DS along a time axis T. In order to simplify the notation, the control signals will be denoted hereinafter by the same references as those of the corresponding scanning lines. Because the sampling transistor Tr1 and the switching transistor Tr3 are both of the P-channel type, the sampling transistor Tr1 and the switching transistor Tr3 are on when the scanning lines WS and DS are at a low level and off when the scanning lines WS and DS are at a high level. Together with the waveforms of the respective control signals WS and DS, this timing chart shows changes in the potential of the gate G of the drive transistor Tr2 and changes in the potential of the source S of the drive transistor Tr2. The timing chart also shows the waveform of the video signal applied to the signal line SL. This video signal has a waveform such that the signal potential Vsig and the reference potential Vofs alternate with each other within one horizontal period (1H period).

In the timing chart of FIG. 3, a period from timing T1 to timing T9 is set as a period of one field. Each row of the pixel array is sequentially scanned once during the period of one field. This timing chart shows the waveforms of the respective scanning lines WS and DS applied to pixels in one row.

Before the timing T1 in which the field in question begins, the sampling transistor Trn is in an off state, whereas the switching transistor Tr3 is in an on state. Thus, the drive transistor Tr2 is connected to the power supply voltage Vcc via the switching transistor Tr3 in the on state. The drive transistor Tr2 is therefore supplying an output current Ids to the light emitting element EL according to a predetermined input voltage Vgs. Thus, in a stage before the timing T1, the light emitting element EL is emitting light. The input voltage Vgs applied to the drive transistor Tr2 at this time is represented by a difference between a gate potential (G) and a source potential (S).

In the timing T1 in which the field in question begins, the control signal DS is changed from a low level to a high level. Thereby, the switching transistor Tr3 is turned off to disconnect the drive transistor Tr2 from the power Vcc. Thus, the light emission stops, and a non-emission period begins.

In a next timing T2, the control signal DS is changed to the low level again to turn on the switching transistor Tr3. Thereby, the source S of the drive transistor Tr2 is raised to the power supply potential Vcc. The gate potential (G) of the drive transistor Tr2 also is shifted upward in such a manner as to be interlocked with the raising of the source S of the drive transistor Tr2 to the power supply potential Vcc.

Thereafter, in a timing T3 in which the signal line SL is at the reference potential Vofs, the control signal WS is changed to a low level to turn on the sampling transistor Tr1. The reference potential Vofs is thereby written to the gate G of the drive transistor Tr2. In this stage, the input voltage Vgs of the drive transistor Tr2 is Vcc−Vofs, which is sufficiently higher than the threshold voltage Vth, and thus the drive transistor Tr2 is set in an ON state. A period from timing T2 past timing T3 is a preparatory period for threshold voltage correction, in which period the source S and the gate G of the drive transistor Tr2 are reset to Vcc and Vofs, respectively.

Thereafter, in a timing T4, the control signal DS is set at the high level to turn off the switching transistor Tr3. On the other hand, the sampling transistor Tr1 remains in the on state. In this case, the current supply is interrupted while gate G of the drive transistor Tr2 remains fixed at the reference potential Vofs, so that the potential of the source S decreases. Eventually, the current stops flowing at a point in time when the drive transistor Tr2 cuts off. When the drive transistor Tr2 cuts off, a potential difference corresponding to precisely the threshold voltage Vth of the drive transistor Tr2 occurs between the source S and the gate G. This potential difference is retained by the retaining capacitance Cs connected between the source S and the gate G of the drive transistor Tr2.

Thereafter, in a timing T5, the control signal WS is set to a high level to turn off the sampling transistor Tr1. The gate G of the drive transistor Tr2 is disconnected from the signal line SL, whereby the threshold voltage correcting operation is completed. Thus, a period from timing T4 to timing T5 is a period for the threshold voltage correcting operation.

In a next timing T6, the control signal WS is set to the low level to turn on the sampling transistor Tr1. At this time, the signal line SL is at the signal potential Vsig. Thus, the signal potential Vsig is sampled by the sampling transistor Tr1 in the ON state and written to the gate G of the drive transistor Tr2.

In a next timing T7, the control signal WS is set to the high level to turn off the sampling transistor Tr1, whereby the operation of writing the signal potential Vsig is completed. That is, the signal potential writing operation of writing the signal potential Vsig to the gate G of the drive transistor Tr2 is performed in a short period T6 to T7 during which the sampling transistor Tr1 is on. Thereby, the input voltage Vgs of the drive transistor Tr2 becomes Vth+Vsig. However, this calculated value is obtained when the reference potential Vofs is set at 0 V.

In the signal potential writing period T6 to T7, a correction for the mobility μ of the drive transistor Tr2 is made simultaneously. The amount of this mobility correction is denoted by ΔV in the timing chart. That is, in the signal potential writing period T6 to T7, the signal potential Vsig is written to the gate G of the drive transistor Tr2, and the potential of the source S of the drive transistor Tr2 changes by ΔV at the same time. Hence, the input voltage Vgs of the drive transistor Tr2 becomes Vsig+Vth−ΔV, to be exact. This amount of change ΔV acts in exactly a direction of cancelling a variation in the mobility μ of the drive transistor Tr2. Specifically, when the mobility μ of the drive transistor Tr2 is relatively high, the amount of change ΔV is large, and the input voltage Vgs is correspondingly compressed so that the effect of the mobility μ can be suppressed. On the other hand, when the drive transistor Tr2 has low mobility μ, the amount of change ΔV is small, and thus the input voltage Vgs is less compressed. Thus, when the mobility μ is low, the input voltage Vgs is prevented from being compressed greatly, and variations in the mobility μ are averaged.

Thereafter, at timing T8, the control signal DS is set to the low level to turn on the switching transistor Tr3. Because the source S of the drive transistor Tr2 is connected to the power supply Vcc, a current starts flowing, and the light emitting element EL starts the light emission. At this time, the gate G of the drive transistor Tr2 also rises due to the bootstrap effect. The gate to source voltage Vgs retained by the retaining capacitance Cs maintains a value of (Vsig+Vth−ΔV). The relation between the drain current Ids and the input voltage Vgs at this time is given in the following Equation 2 by substituting Vsig−ΔV+Vth for Vgs in the earlier Transistor Characteristic Equation 1.

$$Ids=k\mu(Vgs-Vth)^2=k\mu(Vsig-\Delta V)^2 \qquad \text{Equation 2}$$

In the above-described Equation 2, k=(½)(W/L)Cox.

This Characteristic Equation 2 shows that the term of the threshold voltage vth is cancelled and the output current Ids supplied to the light emitting element EL is not dependent on the threshold voltage Vth of the drive transistor Tr2. The drain current Ids is basically determined by the signal potential Vsig of the video signal. In other words, the light emitting element EL emits light at a luminance corresponding to the signal potential Vsig. At this time, the signal potential Vsig is corrected by the amount of change ΔV. The amount of correction ΔV acts exactly to cancel the effect of the mobility μ positioned in a coefficient part of Characteristic Equation 2. Thus, the drain current Ids is in effect dependent only on the signal potential Vsig.

When last timing T9 arrives, the control signal DS is set to the high level to turn off the switching transistor Tr3. Thereby, the light emission is ended, and the field in question is completed. A transition is thereafter made to a next field to repeat the Vth correcting operation, the signal potential writing and mobility correcting operation, and the light emitting operation.

Figure 4:
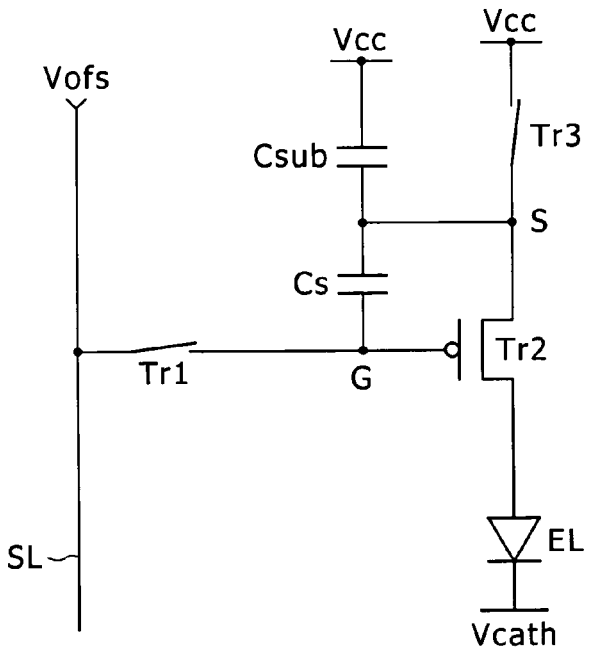
FIG. 4 is a schematic diagram similar to the assistance in explaining the operation of the first embodiment.

Next, the operation of the pixel shown in FIG. 2 will be described in detail with reference to FIGS. 4 to 7. FIG. 4 shows a state of operation of the pixel circuit in the threshold value correction preparatory period T2 to T4. As shown in FIG. 4, the sampling transistor Tr1 and the switching transistor Tr3 are both on during the preparatory period T2 to T4. The signal line SL is at the reference potential Vofs. Thus, in the preparatory period T2 to T4, the power supply voltage Vcc is written to the source S of the drive transistor Tr2, and the reference potential Vofs is written to the gate G of the drive transistor Tr2. The input voltage Vgs of the drive transistor Tr2 therefore becomes Vcc−Vofs. In this case, the reference potential Vofs is set so as to satisfy Vcc−Vofs>|Vth|. Vth is the threshold voltage of the drive transistor Tr2. Under this condition, Vgs>|Vth|, and thus the drive transistor Tr2 is in an ON state. In this state, an unnecessary current flows to the light emitting element EL. In order to prevent this, the preparatory period T2 to T4 is set desirably as short as possible, that is, set at a few μs or less. In addition, the value of the reference potential Vofs is desirably set only slightly higher than the threshold voltage Vth.

Figure 5:
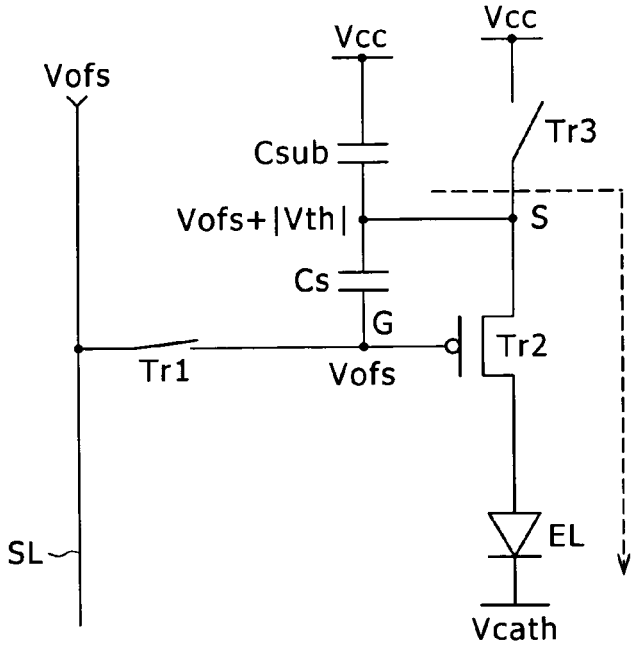
FIG. 5 is a schematic diagram similar to the assistance in explaining the operation of the first embodiment.

FIG. 5 shows a state of operation of the pixel in the threshold value correcting period T4 to T5. The switching transistor Tr3 is off in this state. As a result, a charge stored in the retaining capacitance Cs and the auxiliary capacitance Csub is discharged through the drive transistor Tr2 to the side of the cathode potential Vcath of the light emitting element EL. The source potential of the drive transistor Tr2 falls in this discharging process. At a point in time when the source potential of the drive transistor Tr2 reaches Vofs+|Vth|, the drive transistor Tr2 cuts off. The retaining capacitance Cs connected between the gate G and the source S of the drive transistor Tr2 thereby retains the threshold voltage |Vth| of the drive transistor Tr2. After the threshold voltage correcting operation is thus performed and the sampling transistor Tr1 is turned off.

Figure 6:
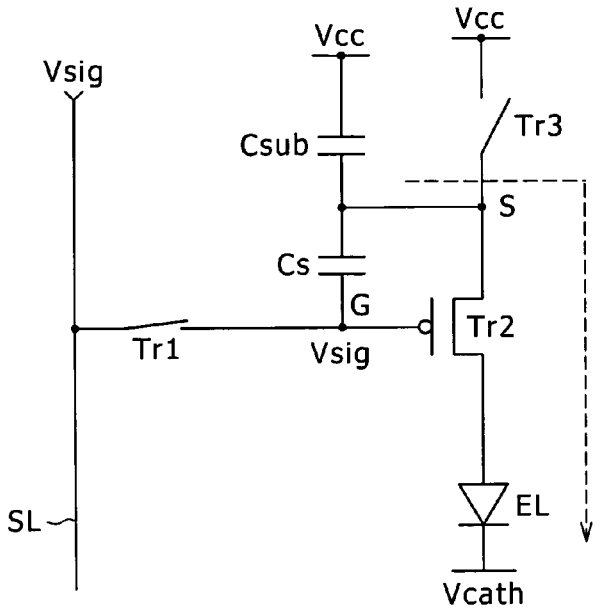
FIG. 6 is a schematic diagram similar to the assistance in explaining the operation of the first embodiment.

FIG. 6 shows a state of operation of the pixel in the signal writing and mobility correcting period T6 to T7. In this state, the signal line SL is changed from the reference potential Vofs to the signal potential Vsig. The sampling transistor Tr1 is turned on again. The signal potential Vsig is written thereby to the gate G of the drive transistor Tr2. On the other hand, a coupling determined by a capacitance ratio between the retaining capacitance Cs and the auxiliary capacitance Csub enters the potential at the source S of the drive transistor Tr2. The input voltage Vgs of the drive transistor Tr2 thereby has a value expressed by the following Equation 3.

$$V_{gs} = |V_{th}| + \frac{Csub}{Cs + Csub}(V_{ofs} - V_{stg}) \qquad \text{Equation 3}$$

In this state, a current flows through the drive transistor Tr2, as indicated by a dotted line. The potential of the source S is thus changed by ΔV, so that a mobility correction is made. That is, the signal writing and mobility correcting period T6 to T7 defines a mobility correcting time t. The mobility correcting time t is as short as the value of a few μs. The current value Ids after the mobility correction is expressed by the following Equation 4.

$$I_{ds} = k\mu\left(\frac{V'_{gs}}{1 + V'_{gs}\frac{k\mu}{C}t}\right)^2 \qquad \text{Equation 4}$$

$$\left(\text{where } V'_{gs} = +\frac{Csub}{Cs + Csub}(V_{ofs} - V_{stg})\right)$$

Figure 7:
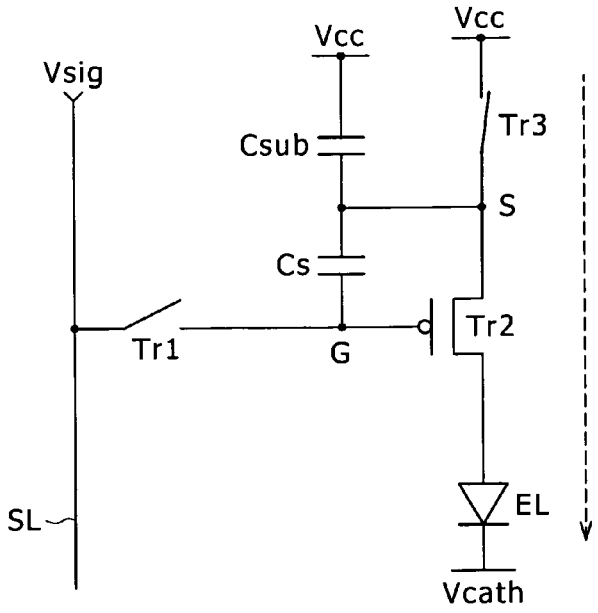
FIG. 7 is a schematic diagram similar to the assistance in explaining the operation of the first embodiment.

FIG. 7 shows a state of operation of the pixel circuit in an emission period T8 to T9. During the emission period, the sampling transistor Tr1 is off, whereas the switching transistor Tr3 is on. Thus, a steady-state current flows from the power supply potential Vcc through the switching transistor Tr3 and the drive transistor Tr2 to the cathode potential Vcath of the light emitting element EL, so that a light emitting operation is performed. The steady-state current (driving current Ids) flowing at this time is controlled by the input voltage Vgs of the drive transistor Tr2. As described above, the input voltage Vgs has already been corrected for variations in the threshold voltage vth and the mobility μ, so that a high-uniformity image quality without variations in luminance can be obtained. Incidentally, in the emission period, the source potential of the drive transistor Tr2 rises to the power supply potential Vcc, and the gate potential of the drive transistor Tr2 also rises in such a manner as to be interlocked with the source potential of the drive transistor Tr2.

As is clear from the above description, in the pixel circuit according to the first embodiment of the present invention, in which the circuit uses a P-channel type drive transistor and to which the switching transistor Tr3 is added, the power supply potential Vcc supplied to each pixel can be fixed. This eliminates the need for a power supply scanner for supplying a power supply pulse and the need for a large output buffer size. It is thus possible to secure a wide layout area for a screen, which area is occupied in a panel, and achieve a longer life. In addition, it is generally known that the variations in characteristics of a P-channel type drive transistor without a LDD region are smaller than those of a N-channel type drive transistor. Thus, in the present invention, by selecting the drive transistor Tr2 of the P-channel type, the variations in characteristics of the drive transistor Tr2 can be suppressed, and they are easily corrected. In addition, in the present invention, the amplitude of the voltage applied to the drive transistor Tr2 is about Vcc−Vcath at a maximum. This voltage Vcc−Vcath is about 10 V. It is thus possible to secure a sufficient margin for the withstand voltage of the drive transistor Tr2, and reduce the thickness of a gate insulating film, for example.

A display device according to a second embodiment of the present invention will be described next. This embodiment can variably adjust a mobility correcting time t automatically according to the level of signal potential.

Figure 8:
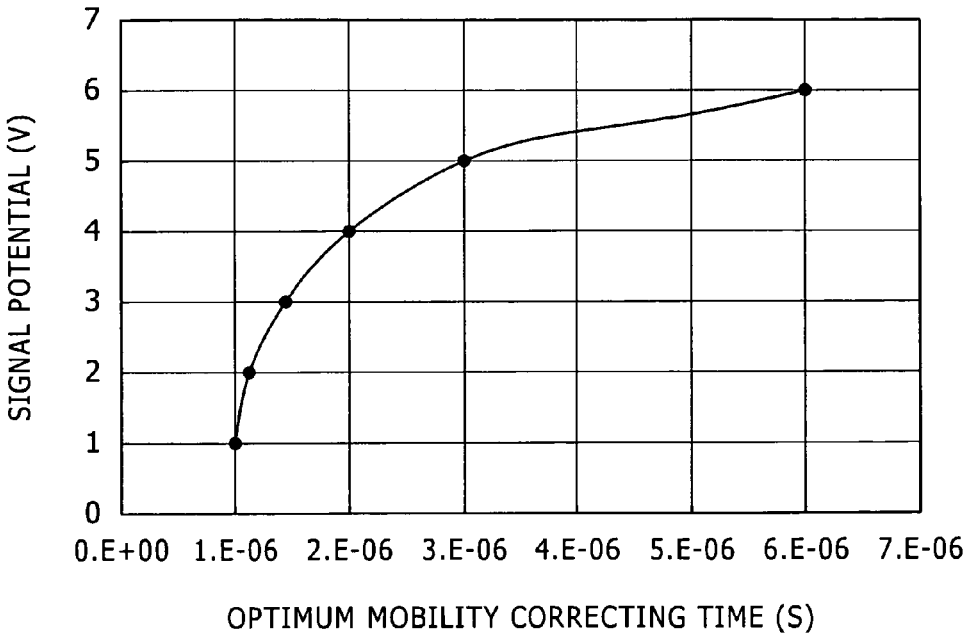
FIG. 8 is a graph of assistance in explaining the display device according to a second embodiment of the present invention.

FIG. 8 is a graph showing the relation between a signal potential and an optimum mobility correcting time. The y axis indicates the signal potential, and the x axis indicates the optimum mobility correcting time. In a case where a drive transistor Tr2 is of the P-channel type, as in the present invention, the driving current is increased and the light emission luminance is heightened as the signal potential becomes lower. Hence, the light emission luminance changes from a white level through a gray level to a black level as the signal potential is shifted upward. As is clear from the graph, the optimum mobility correcting time tends to be relatively short when the signal potential is at the white level, and tends to be contrarily long when the signal potential is at the black level. In order to improve the uniformity of a screen and enhance the image quality, it is desirable to control the mobility correcting time adaptively according to the signal potential.

Figure 9:
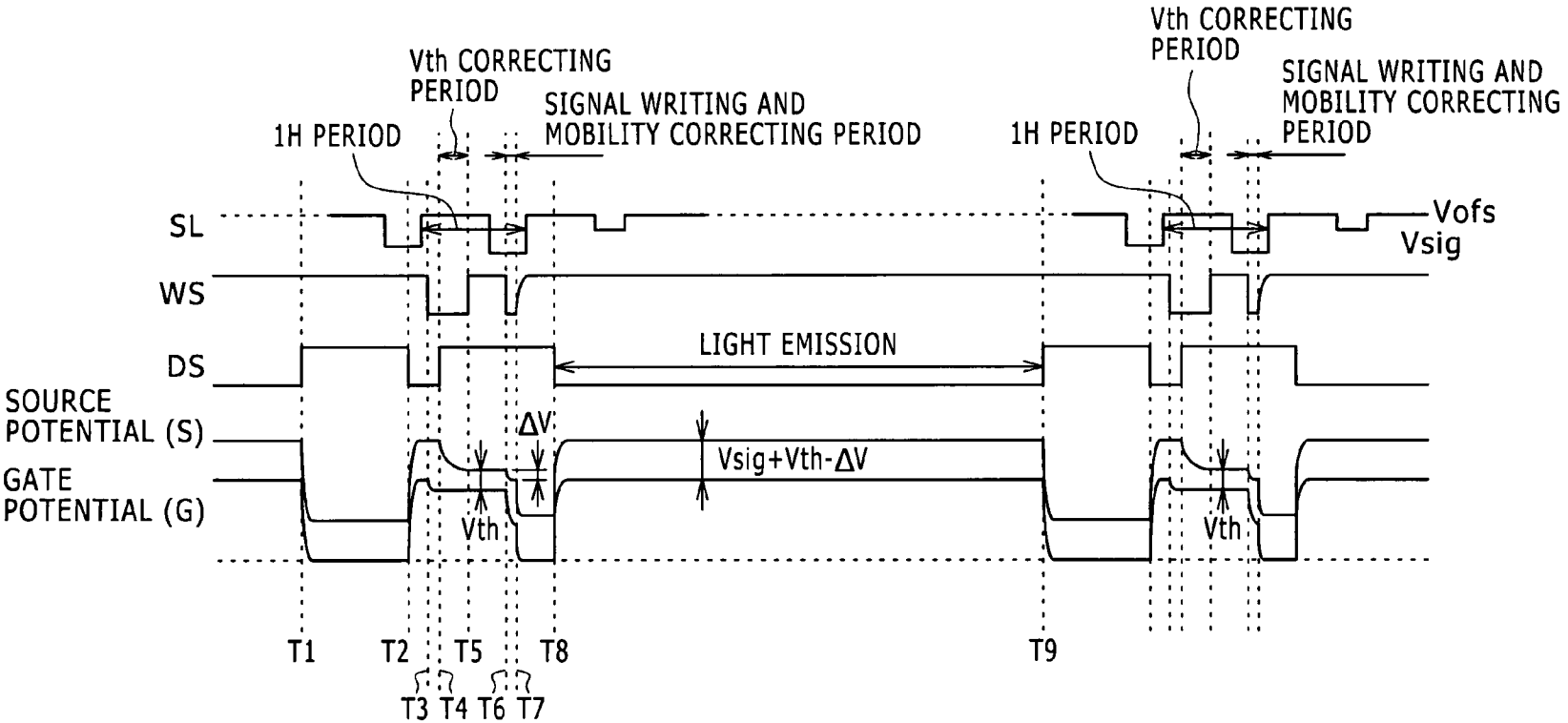
FIG. 9 is a timing chart similar to the assistance in explaining the second embodiment.

FIG. 9 is a timing chart of assistance in explaining the operation of the display device according to the second embodiment of the present invention. In order to facilitate an understanding, parts corresponding to the timing chart of the first embodiment in FIG. 3 are identified by the same references. The second embodiment is different from the first embodiment in that the rising edge of a negative polarity pulse of a control signal WS defining a signal writing and mobility correcting period is blunted. Thereby, the mobility correcting time t can be variably adjusted automatically according to the level of the signal potential Vsig.

Figure 10:
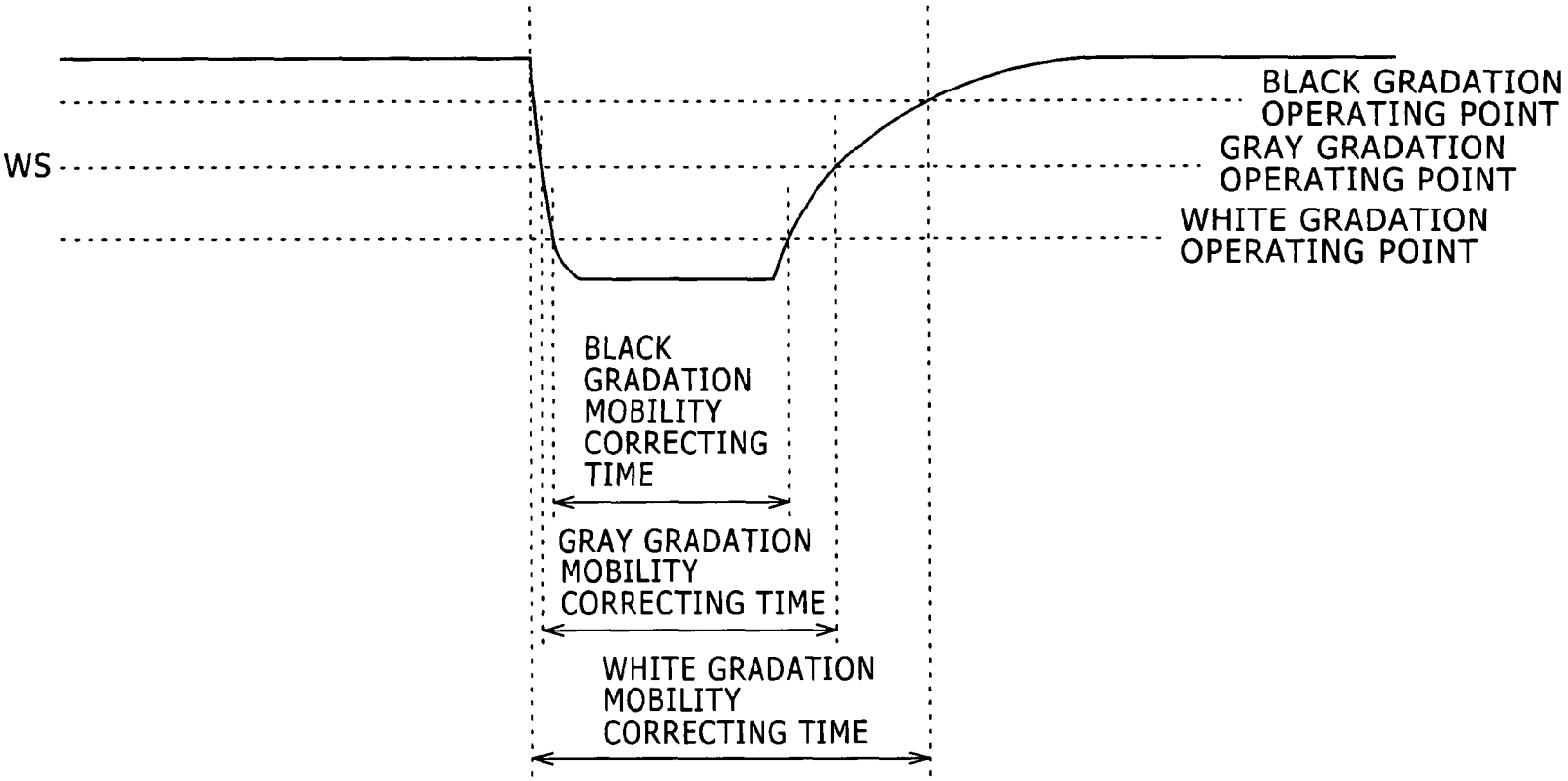
FIG. 10 is a waveform chart similar to the assistance in explaining the second embodiment.

FIG. 10 is a waveform chart showing in enlarged dimension the negative polarity pulse of the control signal WS appearing in a period from timing T6 to timing T7 shown in FIG. 9. A sampling transistor Tr1 is of the P-channel type. The sampling transistor Tr1 is turned on by changing a control signal WS from a high level to a low level, and is conversely turned off by changing the control signal WS from the low level to the high level. A falling edge from the high level to the low level is sharp, so that the sampling transistor Tr1 is turned on instantly. On the other hand, a rising edge waveform during the change from the low level to the high level is blunted, and the off timing differs according to operating points. The signal potential Vsig is applied to the source side of the sampling transistor Tr1, and the control signal WS is applied to the gate side of the sampling transistor Tr1. The operating point of the sampling transistor Tr1 differs according to the signal potential Vsig. At a white gradation at which the signal potential Vsig is low, the operating point is also low, and thus the sampling transistor Tr1 is turned off relatively early. Therefore, the mobility correcting time at the white gradation is relatively short. On the other hand, when the signal potential Vsig is at a black gradation, the operating point approaches the high level. Thus, a timing in which the sampling transistor Tr1 is turned off is shifted rearward, and the mobility correcting time at the black gradation is lengthened. The mobility correcting time at a gray gradation intermediate between the white gradation and the black gradation is also intermediate. Thus, the present embodiment can optimally adjust the mobility correcting time automatically according to the level of the signal potential Vsig. For such a mobility correction, the sampling transistor Tr1 is desirably of the P-channel type rather than of the N-channel type.

Figure 11:
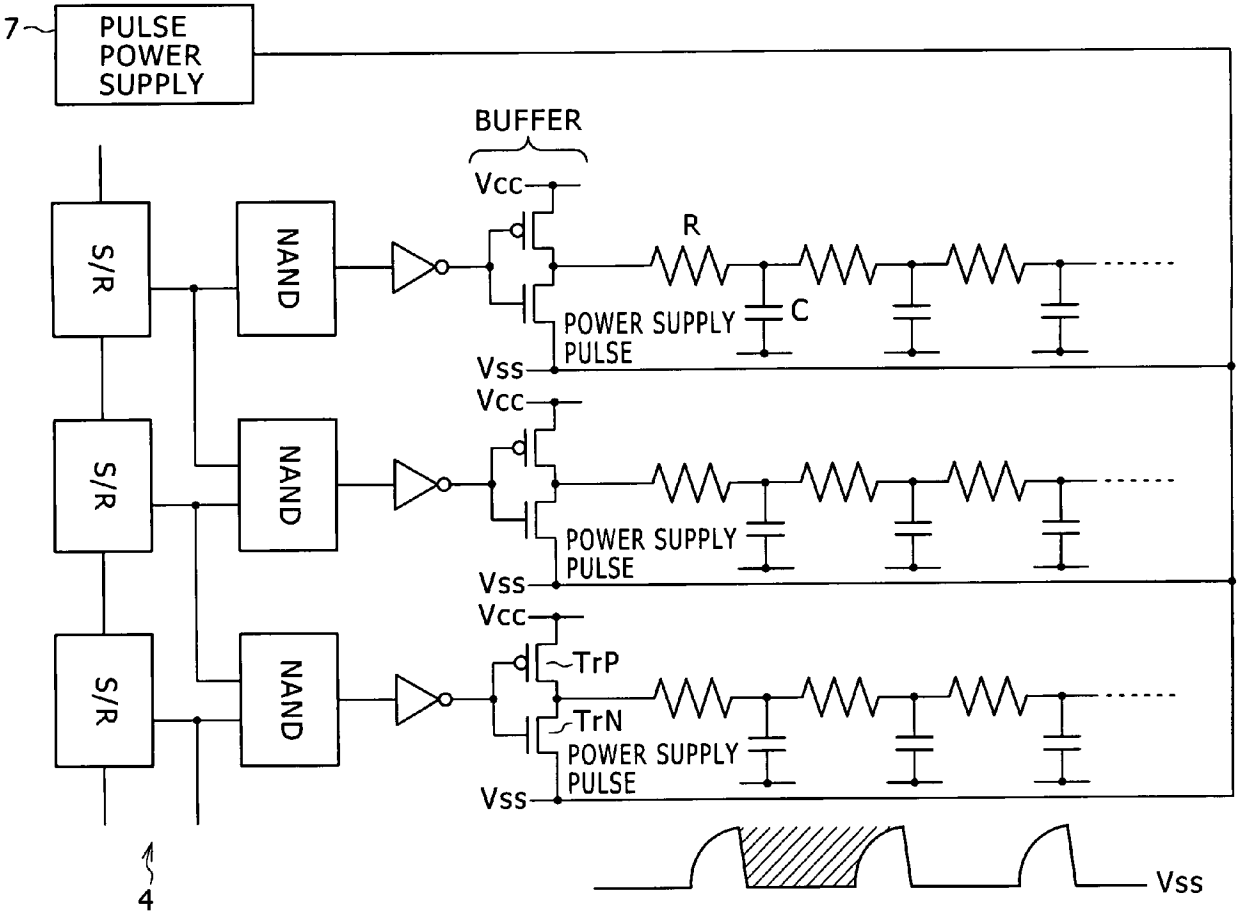
FIG. 11 is a circuit diagram showing a configuration of a write scanner used in the second embodiment.

FIG. 11 is a circuit diagram showing an embodiment of a write scanner used in the second embodiment. FIG. 11 schematically shows three stages of an output part of the write scanner 4 and three rows (three lines) of a pixel array unit 1 connected to the write scanner 4. The write scanner 4 is formed by shift registers S/R. The write scanner 4 operates according to a clock signal input externally to sequentially transfer a start signal similarly input externally and thereby sequentially output a signal in each stage. NAND elements are connected to the respective stages of the shift registers S/R. The NAND elements subject sequential signals output from shift registers S/R in stages adjacent to each other to NAND processing, and thereby generates a rectangular waveform serving as a basis for a control signal. This rectangular waveform is input to an output buffer via an inverter. The output buffer operates according to the input signal supplied from the shift register S/R side to supply a final control signal to a corresponding scanning line WS of the pixel array unit 1.

The output buffer is formed by a pair of switching elements connected in series with each other between a power supply potential Vcc and a ground potential Vss. One switching element is a P-channel type transistor TrP, and the other is an N-channel type transistor TrN. Incidentally, the lines on the pixel array unit 1 side, which lines are connected to respective output buffers, are represented by resistive components R and capacitive components C in an equivalent circuit. In this case, a pulse power supply 7 is connected to the grounding line Vss of the output buffer in each stage. This pulse power supply 7 outputs a power supply pulse in a 1H cycle, and supplies the power supply pulse to the grounding line Vss. The output buffer extracts the power supply pulse according to the input pulse supplied from the NAND element side, and supplies the power supply pulse as an output pulse to the scanning line WS side. As shown in a lower part of FIG. 11, the hatched power supply pulse of negative polarity has a steep falling edge and a gentle rising edge. The gentle part of the rising edge is extracted as it is to be used as the control signal WS for automatic control of the mobility correcting time.

Figure 12:
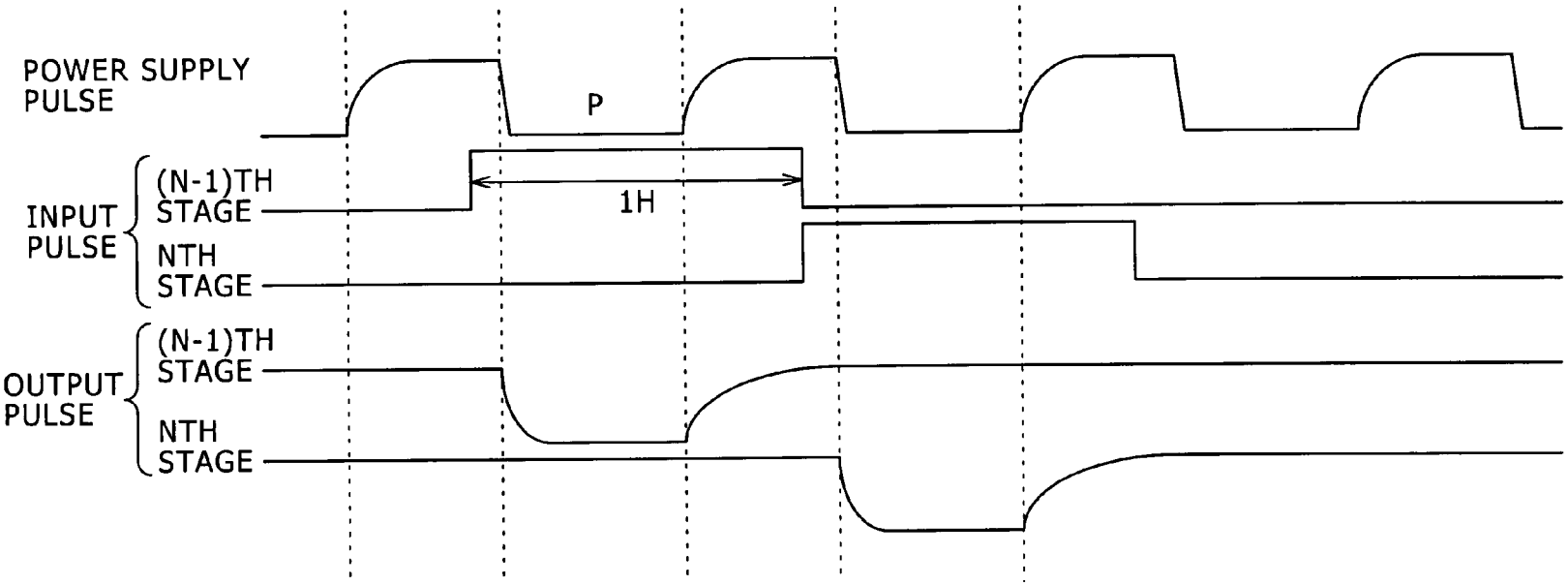
FIG. 12 is a timing chart of assistance in explaining the operation of the write scanner shown in FIG. 11.

FIG. 12 is a timing chart of assistance in explaining the operation of the write scanner shown in FIG. 11. As shown in FIG. 12, the pulse power supply 7 outputs a power supply pulse train including a negative-polarity pulse P to the grounding line of the output buffers in each 1H period. The timing chart of FIG. 12 also shows input pulses and output pulses of output buffers whose time series coincides with that of the power supply pulse. FIG. 12 shows input pulses and output pulses supplied to output buffers in a (N−1)th stage and a Nth stage. An input pulse is a rectangular pulse shifted by one H in each stage. When an input pulse is supplied to the output buffer in the (N−1)th stage, an inverter is turned on to extract the pulse P as it is from the grounding line. This pulse P becomes the output pulse of the output buffer in the (N−1)th stage, and it is then output as it is to the corresponding (N−1) th scanning line WS. Similarly, when an input pulse is applied to the output buffer in the Nth stage, an output pulse is output from the output buffer in the Nth stage to the corresponding scanning line WS.

Figure 13:
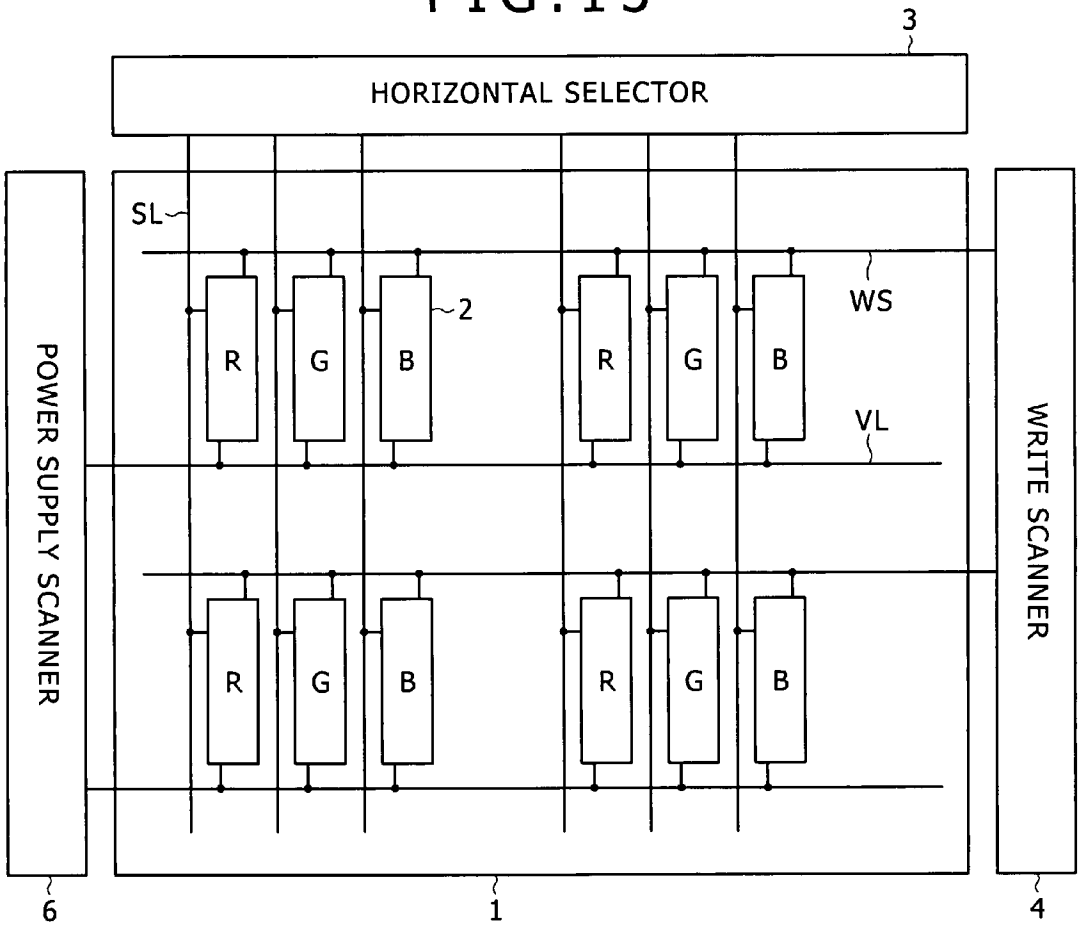
FIG. 13 is a block diagram showing a general configuration of a display device according to a reference example.

For reference, an example of a display device in which a power supply line is not fixed at a power supply potential Vcc, but is supplied with a pulse will be described in the following. FIG. 13 is a block diagram showing a general configuration of the display device according to the present reference example. As shown in FIG. 13, the display device includes a pixel array unit 1 and a driving unit for driving the pixel array unit 1. The pixel array unit 1 includes scanning lines WS in the form of rows, signal lines SL in the form of columns, pixels 2 in the form of a matrix, which pixels are disposed at parts where the scanning lines WS and the signal lines SL intersect each other, and feeder lines (power supply lines) VL arranged in correspondence with each rows of the pixels 2. Incidentally, in the present example, one of three RGB primary colors is assigned to each of the pixels 2, thus enabling a color display. However, the display device is not limited to this, and it includes a monochrome display device. The driving unit includes: a write scanner 4 for performing line-sequential driving of the pixels 2 in row units by sequentially supplying a control signal to the respective scanning lines WS; a power supply scanner 6 for supplying a power supply voltage changing between a first potential and a second potential to each feeder line according to the line-sequential driving; and a signal selector (horizontal selector) 3 for supplying a signal-potential as a driving signal and a reference potential to the signal lines SL in the form of columns according to the line-sequential driving.

Figure 14:
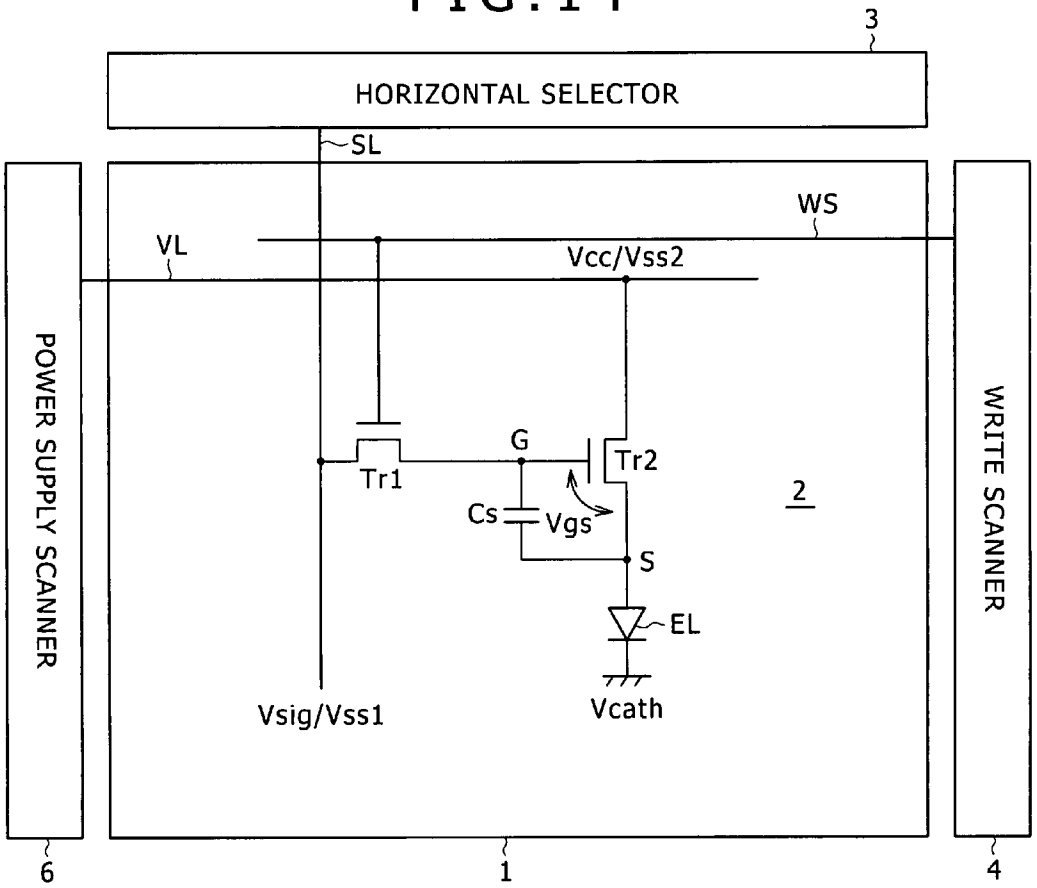
FIG. 14 is a circuit diagram showing a concrete configuration of the display device shown in FIG. 13.

FIG. 14 is a circuit diagram showing a concrete configuration and connection relation of a pixel 2 included in the display device according to the reference example shown in FIG. 13. As shown in FIG. 13, the pixel 2 includes a light emitting element EL typified by an organic EL device or the like, a sampling transistor Tr1, a drive transistor Tr2, and a retaining capacitance Cs. The control terminal (gate) of the sampling transistor Tr1 is connected to the corresponding scanning line WS, one of the pair of current terminals (source and drain) of the sampling transistor Tr1 is connected to the corresponding signal line SL, and the other of the pair of current terminals of the sampling transistor Tr1 is connected to the control terminal (gate G) of the drive transistor Tr2. One of the pair of current terminals (source S and drain) of the drive transistor Tr2 is connected to the light emitting element EL, and the other of the pair of current terminals of the drive transistor Tr2 is connected to the corresponding feeder line VL. In the present example, the drive transistor Tr2 is of the N-channel type. The drain of the drive transistor Tr2 is connected to the feeder line VL, while the source S of the drive transistor Tr2 is connected as an output node to the anode of the light emitting element EL. The cathode of the light emitting element EL is connected to a predetermined cathode potential Vcath. The retaining capacitance Cs is connected between the source S as one current terminal of the drive transistor Tr2 and the gate G as control terminal of the drive transistor Tr2.

In such a configuration, the sampling transistor Tr1 conducts according to a control signal supplied from the scanning line WS to sample a signal potential supplied from the signal line SL and retain the signal potential in the retaining capacitance Cs. The drive transistor Tr2 is supplied with a current from the feeder line VL at the first potential (high potential Vdd), and passes a driving current through the light emitting element EL according to the signal potential retained in the retaining capacitance Cs. In order to set the sampling transistor Tr1 in a conducting state in a time period in which the signal line SL is at the signal potential, the write scanner 4 outputs the control signal of a predetermined pulse width to the scanning line WS, whereby the signal potential is retained in the retaining capacitance Cs, and a correction for the mobility μ of the drive transistor Tr2 is made to the signal potential at the same time. Thereafter, the drive transistor Tr2 supplies the light emitting element EL with the driving current according to the signal potential Vsig written to the retaining capacitance Cs. A light emitting operation thus begins.

The pixel 2 has a threshold voltage correcting function as well as the above-described mobility correcting function. Specifically, the power supply scanner 6 changes the feeder line VL from the first potential (high potential Vdd) to the second potential (low potential Vss2) in a first timing before the sampling transistor Tr1 samples the signal potential Vsig. In addition, the write scanner 4 makes the sampling transistor Tr1 conduct to apply a reference potential Vss1 from the signal line SL to the gate G of the drive transistor Tr2 in a second timing before the sampling transistor Tr1 samples the signal potential Vsig, and the source S of the drive transistor Tr2 is set to the second potential (Vss2). In a third timing after the second timing, the power supply scanner 6 changes the feeder line VL from the second potential Vss2 to the first potential Vdd to retain a voltage corresponding to the threshold voltage Vth of the drive transistor Tr2 in the retaining capacitance Cs. By such a threshold voltage correcting function, the display device can cancel the effect of the threshold voltage Vth of the drive transistor Tr2, in which the threshold voltage varies in each pixel.

The pixel 2 also has a bootstrap function. Specifically, the write scanner 4 cancels the application of the control signal to the scanning line WS in a stage in which the signal potential Vsig is retained in the retaining capacitance Cs, so that the sampling transistor Tr1 is set in a non-conducting state to electrically disconnect the gate G of the drive transistor Tr2 from the signal line SL. Thereby, the potential of the gate G of the drive transistor Tr2 is interlocked with a variation in potential of the source S of the drive transistor Tr2, and thus a voltage Vgs between the gate G and the source S can be held constant.

Figure 15:
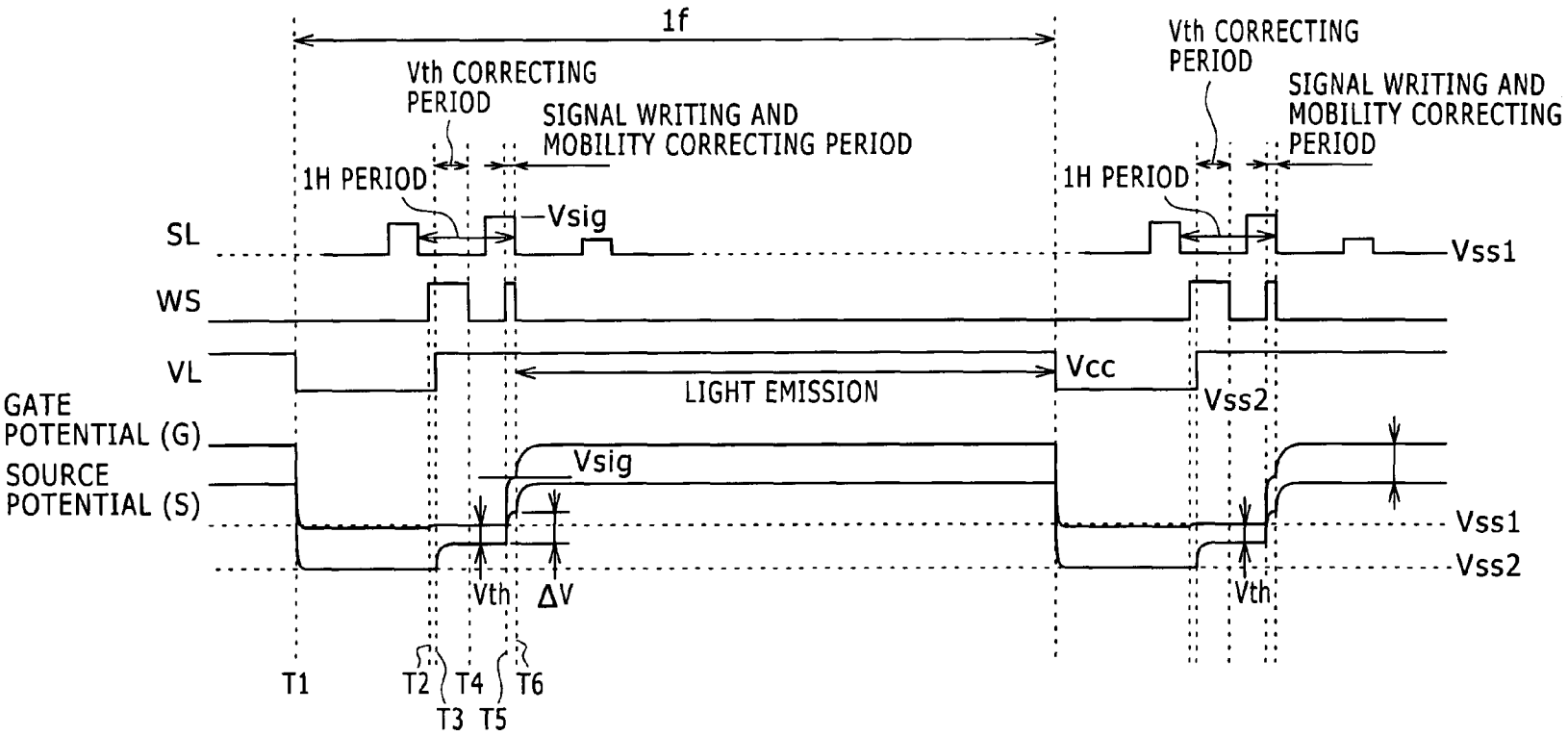
FIG. 15 is a timing chart of assistance in explaining an operation of the display device according to the reference example.

FIG. 15 is a timing chart of assistance in explaining the operation of the pixel 2 shown in FIG. 14. FIG. 15 shows changes in potential of the scanning line WS, changes in potential of the feeder line VL, and changes in potential of the signal line SL along a common time axis. In parallel with these potential changes, changes in potential of the gate G and the source S of the drive transistor also are shown.

A control signal pulse for turning on the sampling transistor Tr1 is applied to the scanning line WS. This control signal pulse is applied to the scanning line WS in a cycle of one field (1f) according to the line-sequential driving of the pixel array unit. This control signal pulse includes two pulses during one horizontal scanning period (1H). Hereinafter, in the present specification, the first pulse may be referred to as a first pulse P1, and the subsequent pulse may be referred to as a second pulse P2. The feeder line VL changes between the high potential Vdd and the low potential Vss2 in the same cycle of one field (1f). The signal line SL is supplied with a driving signal changing between the signal potential Vsig and the reference potential Vss1 within one horizontal scanning period (1H).

As shown in the timing chart of FIG. 15, the pixel enters the non-emission period of a field in question from the emission period of a previous field, and thereafter the emission period of the field in question begins. During the non-emission period, a preparatory operation, a threshold voltage correcting operation, a signal writing operation, and a mobility correcting operation and the like are performed.

During the emission period of the previous field, the feeder line VL is at the high potential Vdd, and the drive transistor Tr2 supplies a driving current Ids to the light emitting element EL. The driving current Ids passes from the feeder line VL through the light emitting element EL via the drive transistor Tr2, and then flows into a cathode line.

Next, when the non-emission period of the field in question begins, the feeder line VL is changed from the high potential Vdd to the low potential Vss2 in a first timing T1. Thereby, the feeder line VL is discharged to the low potential Vss2, and the potential of the source S of the drive transistor Tr2 drops to the low potential Vss2. The anode potential of the light emitting element EL (that is, the source potential of the drive transistor Tr2) is thus set in a reverse bias state, so that the driving current stops flowing and the light emitting element EL is turned off. The potential of the gate G of the drive transistor also drops in such a manner as to be interlocked with the drop in potential of the source S of the drive transistor.

In a next timing T2, the scanning line WS is changed from a low level to a high level to thereby set the sampling transistor Tr1 in a conducting state. At this time, the signal line SL is at the reference potential Vss1. Thus, the potential of the gate G of the drive transistor Tr2 becomes the reference potential Vss1 of the signal line SL through the conducting sampling transistor Tr1. The potential of the source S of the drive transistor Tr2 at this time is the potential Vss2, which is sufficiently lower than the reference potential Vss1. The voltage Vgs between the gate G and the source S of the drive transistor Tr2 is thus initialized so as to be larger than the threshold voltage Vth of the drive transistor Tr2. A period T1 to T3 from timing T1 to timing T3 is a preparatory period for setting the voltage Vgs between the gate G and the source S of the drive transistor Tr2 equal to or larger than the threshold voltage Vth in advance.

Thereafter, in a timing T3, the feeder line VL makes a transition from the low potential Vss2 to the high potential Vdd, and the potential of the source S of the drive transistor Tr2 starts rising. After a while, the current cuts off when the voltage Vgs between the gate G and the source S of the drive transistor Tr2 becomes the threshold voltage Vth. Thus, a voltage corresponding to the threshold voltage Vth of the drive transistor Tr2 is written to the retaining capacitance Cs. This is the threshold voltage correcting operation. At this time, in order for the current to flow only to the retaining capacitance Cs side and not to flow through the light emitting element EL, a cathode potential Vcath is set such that the light emitting element EL cuts off.

In a timing T4, the scanning line WS returns from the high level to the low level. In other words, the first pulse P1 applied to the scanning line WS is cancelled, so that the sampling transistor is set in an off state. As is clear from the above description, the first pulse P1 is applied to the gate of the sampling transistor Tr1 to perform the threshold voltage correcting operation.

Thereafter, the signal line SL changes from the reference potential Vss1 to the signal potential Vsig. Next, in a timing T5, the scanning line WS rises from the low level to the high level again. In other words, the second pulse P2 is applied to the gate of the sampling transistor Tr1. Thereby, the sampling transistor Tr1 is turned on again to sample the signal potential Vsig from the signal line SL. The potential of the gate G of the drive transistor Tr2 therefore becomes the signal potential Vsig. In this case, because the light emitting element EL is first in a cutoff state (high-impedance state), the current flowing between the drain and the source of the drive transistor Tr2 flows entirely into the retaining capacitance Cs and an equivalent capacitance of the light emitting element EL, and starts a charge. Thereafter, the potential of the source S of the drive transistor Tr2 rises by ΔV before timing T6, in which timing the sampling transistor Tr1 is turned off. Thus, the signal potential Vsig of a video signal is written to the retaining capacitance Cs in a form of being added to the threshold voltage Vth, and the voltage ΔV for mobility correction is subtracted from the voltage retained in the retaining capacitance Cs. Hence, a period T5 to T6 from timing T5 to timing T6 is a signal writing and mobility correcting period. In other words, a signal writing and mobility correcting operation is performed when the second pulse P2 is applied to the scanning line WS. The signal writing and mobility correcting period T5 to T6 is equal to the pulse width of the second pulse P2. That is, the pulse width of the second pulse P2 defines the mobility correcting period.

Thus, the writing of the signal potential Vsig and the adjustment of the amount of correction ΔV are performed simultaneously during the signal writing period T5 to T6. The higher the signal potential Vsig, the larger the current Ids supplied by the drive transistor Tr2, and the higher the absolute value of the amount of correction ΔV. Hence, a mobility correction is made according to the level of light emission luminance. When the signal potential Vsig is fixed, the higher the mobility μ of the drive transistor Tr2, and the higher absolute value of the amount of correction ΔV. In other words, the higher the mobility μ, the larger the amount of negative feedback ΔV to the retaining capacitance Cs. Therefore, variations in the mobility μ of each pixel can be removed.

Finally, in a timing T6, the scanning line WS changes to the low level side, as described above, to set the sampling transistor Tr1 in an off state. The gate G of the drive transistor Tr2 is thereby disconnected from the signal line SL. At the same time, a drain current Ids starts to flow through the light emitting element EL. The anode potential of the light emitting element EL thereby rises according to the driving current Ids. The rise in the anode potential of the light emitting element EL is none other than a rise in potential of the source S of the drive transistor Tr2. When the potential of the source S of the drive transistor Tr2 rises, the potential of the gate G of the drive transistor Tr2 also rises in such a manner as to be interlocked with the potential of the source S of the drive transistor Tr2 due to the bootstrap operation of the retaining capacitance Cs. The amount of the rise in the gate potential is equal to the amount of the rise in the source potential. Thus, the voltage Vgs between the gate G and the source S of the drive transistor Tr2 is held constant during the emission period. The value of the voltage Vgs is a result of correcting the signal potential Vsig for the threshold voltage Vth and the mobility μ. The drive transistor Tr2 operates in the saturation region. That is, the drive transistor Tr2 supplies the driving current Ids corresponding to the gate-to-source voltage Vgs. The value of the voltage Vgs is a result of correcting the signal potential Vsig for the threshold voltage Vth and the mobility μ.

Figure 16:
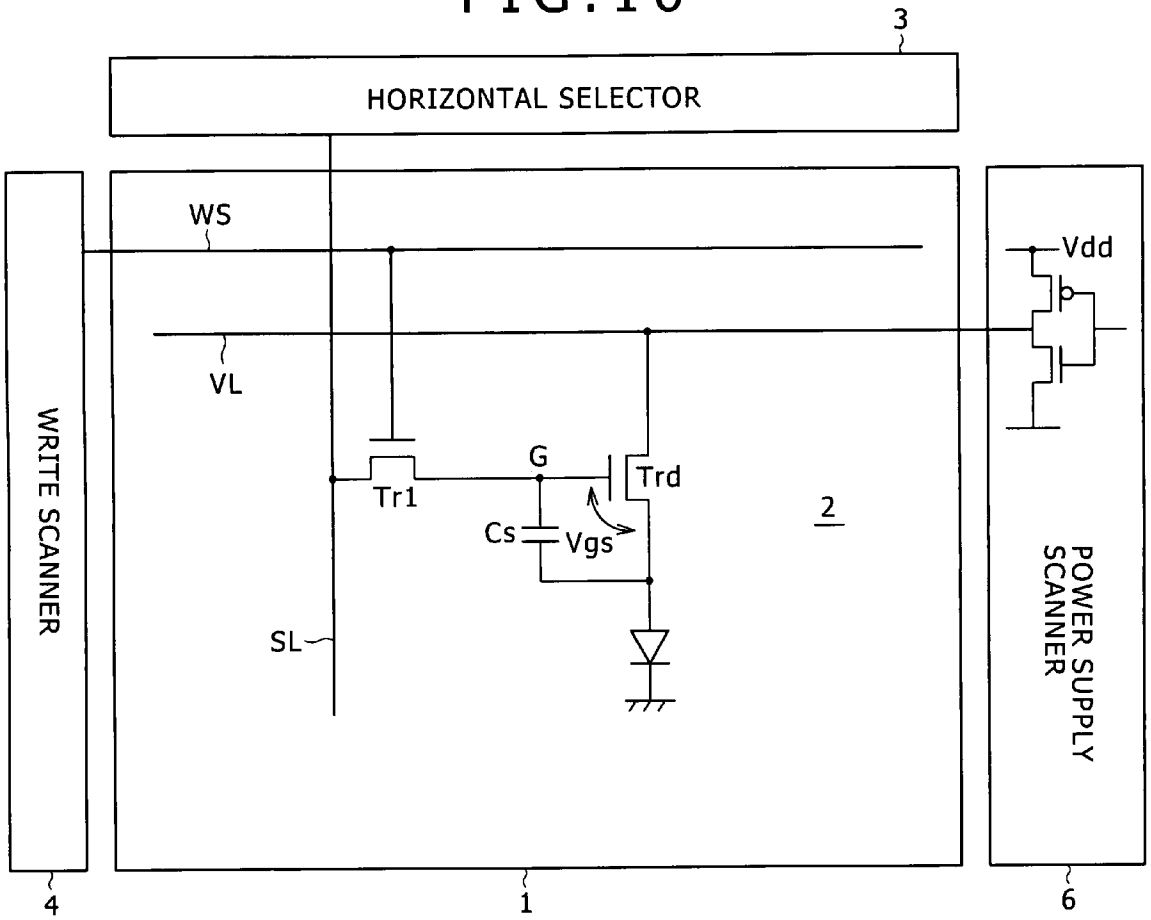
FIG. 16 is a schematic diagram similar to the assistance in explaining the reference example.

FIG. 16 is a schematic diagram showing an enlarged dimension of the power supply scanner 6 in the display device according to the reference example shown in FIG. 13 and FIG. 14. As shown in FIG. 16, the power supply scanner 6 has an output buffer formed by an inverter in each stage. The output buffer outputs a power supply pulse to the corresponding feeder line VL. As described above, the display device according to the reference example supplies the power supply line with a pulse. The pulse is supplied as a power supply pulse VL from the power supply scanner 6 to the pixel side. At the time of light emission, a panel power supply is at the high potential Vdd, and thus the P-channel transistor of the buffer in a last stage of the power supply scanner 6 is turned on to supply the power supply voltage to the pixel side. The light emission current of one pixel is a few μA. Because about 1,000 pixels are connected to each other per line (per row) along a horizontal direction, the total output current is a few mA. In order to prevent a voltage drop when the driving current is made to flow, an output buffer of a large size of a few mm needs to be laid out, thus resulting in a large layout area. Further, because the light emission current continues flowing at all times, the characteristics of the transistor of the output buffer are degraded sharply, and thus a reliability in long-term use may not be obtained.

Figure 17:
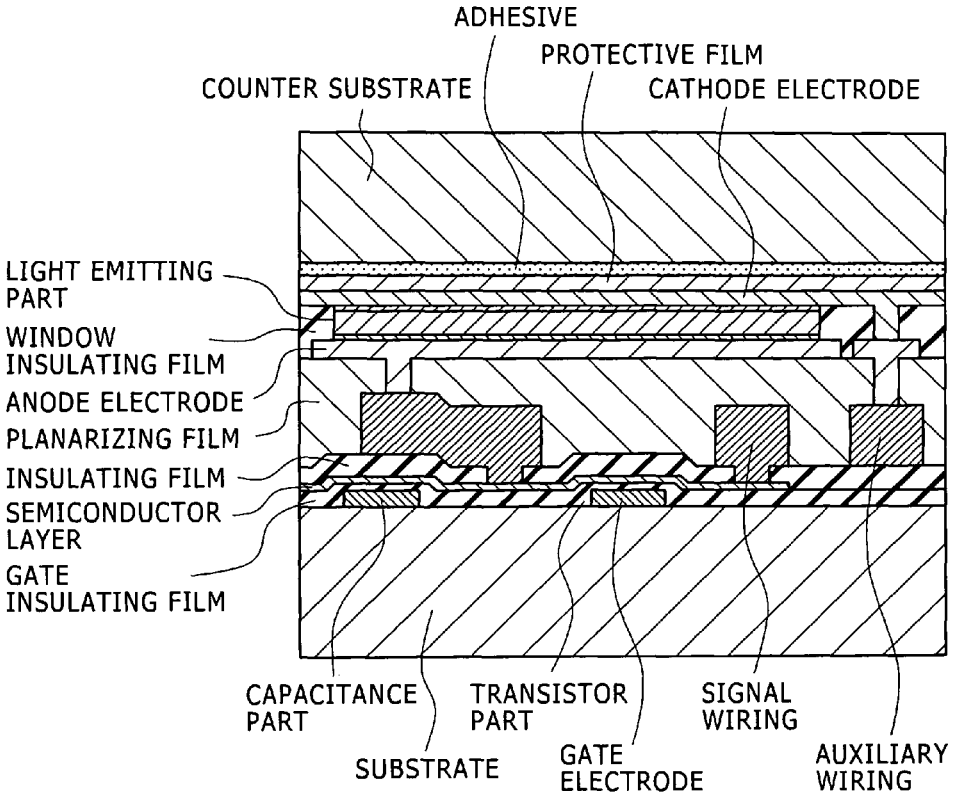
FIG. 17 is a sectional view of a device structure of a display device according to an embodiment of the present invention.

A display device according to an embodiment of the present embodiment has a thin film device structure as shown in FIG. 17. This figure schematically shows a sectional structure of a pixel formed on an insulative substrate. As shown in FIG. 17, the pixel includes a transistor part including a plurality of thin film transistors (one TFT is illustrated in the figure), a capacitance part of a retaining capacitance and the like, and a light emitting part of an organic EL element and the like. The transistor part and the capacitance part are formed on the substrate by a TFT process, and the light emitting part of the organic EL element and the like is stacked on the transistor part and the capacitance part. A transparent counter substrate is attached on the light emitting part via an adhesive to form a flat panel.

Figure 18:
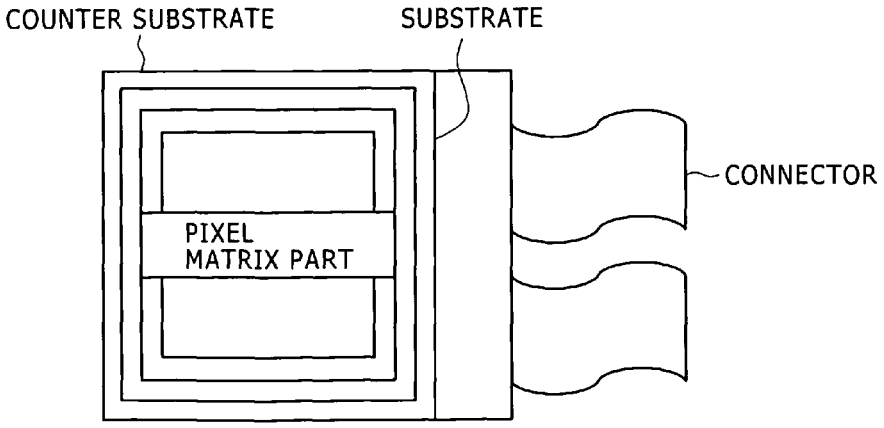
FIG. 18 is a top plan view of assistance in explaining a module configuration of a display device according to an embodiment of the present invention.

A display device according to an embodiment of the present invention includes a display device of a flat module shape as shown in FIG. 18. For example, a pixel array unit in which pixels each including an organic EL element, a thin film transistor, a thin film capacitance and the like are integrated and formed in the form of a matrix is disposed on an insulative substrate. An adhesive is disposed in such a manner as to surround the pixel array unit (pixel matrix part), and a counter substrate, such as a glass or the like, is attached to form a display module. The transparent counter substrate may be provided with color filters, a protective film, a light shielding film and the like, as demanded. The display module may be provided with a FPC (Flexible Printed Circuit), for example, as a connector for externally inputting or outputting a signal and the like into the pixel array unit.

The display devices according to the above-described embodiments of the present invention have a flat panel shape and are applicable to displays of various electronic devices in every field that displays a driving signal input to the electronic devices or generated within the electronic devices as an image or video. The electronic devices include a digital camera, a laptop personal computer, a portable telephone, and a video camera. Examples of electronic devices to which such a display device is applied will be illustrated in the following.

Figure 19:
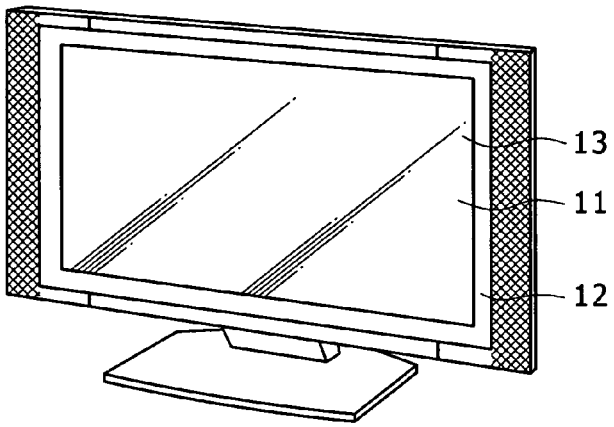
FIG. 19 is a perspective view of a television set including a display device according to an embodiment of the present invention.

FIG. 19 shows a television set to which the present invention is applied. The television set includes a video display screen 11 composed of a front panel 12, a filter glass 13 and the like. The television set is fabricated using a display device according to an embodiment of the present invention as the video display screen 11.

Figure 20:
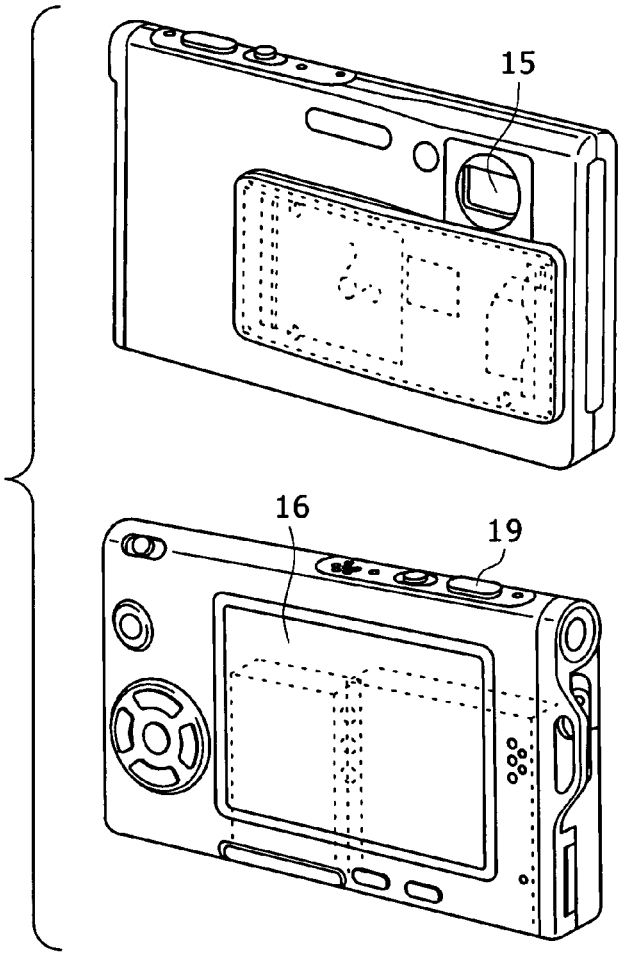
FIG. 20 is a perspective view of a digital still camera including a display device according to an embodiment of the present invention.

FIG. 20 shows a digital camera to which the present invention is applied, an upper part of FIG. 20 being a front view, and a lower part of FIG. 20 being a rear view. The digital camera includes an image pickup lens, a light emitting unit 15 for flashlight, a display unit 16, a control switch, a menu switch and a shutter 19. The digital camera is fabricated using a display device according to an embodiment of the present invention as the display unit 16.

Figure 21:
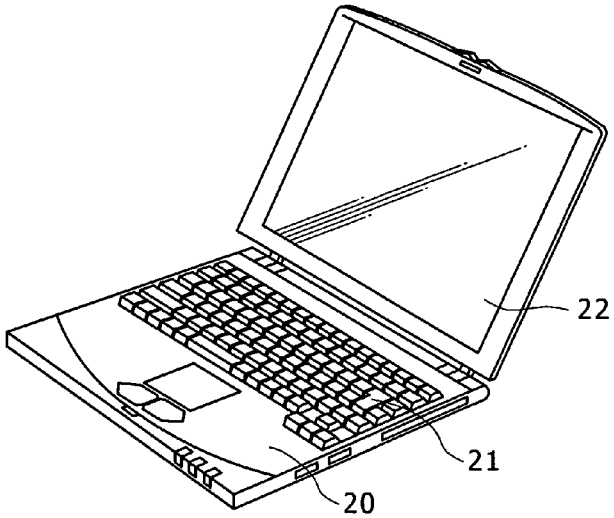
FIG. 21 is a perspective view of a laptop personal computer including a display device according to an embodiment of the present invention.

FIG. 21 shows a laptop personal computer to which the present invention is applied. A main unit 20 of the laptop personal computer includes a keyboard 21 operated to input characters and the like, and a main unit cover of the laptop personal computer includes a display unit 22 for displaying an image. The laptop personal computer is fabricated using a display device according to an embodiment of the present invention as the display unit 22.

Figure 22:
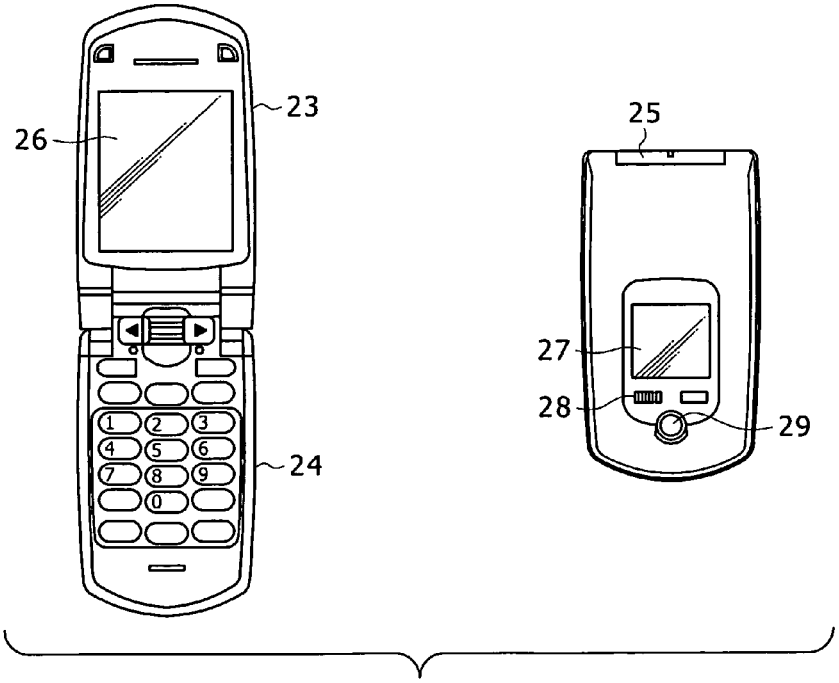
FIG. 22 is a schematic diagram showing a portable terminal device including a display device according to an embodiment of the present invention.

FIG. 22 shows a portable terminal device to which the present invention is applied, a left part of FIG. 22 showing an opened state, and a right part of FIG. 22 showing a closed state. The portable terminal device includes an upper side casing 23, a lower side casing 24, a coupling part (a hinge part in this case) 25, a display 26, a sub-display 27, a picture light 28 and a camera 29. The portable terminal device is fabricated using a display device according to an embodiment of the present invention as the display 26 and the sub-display 27.

Figure 23:
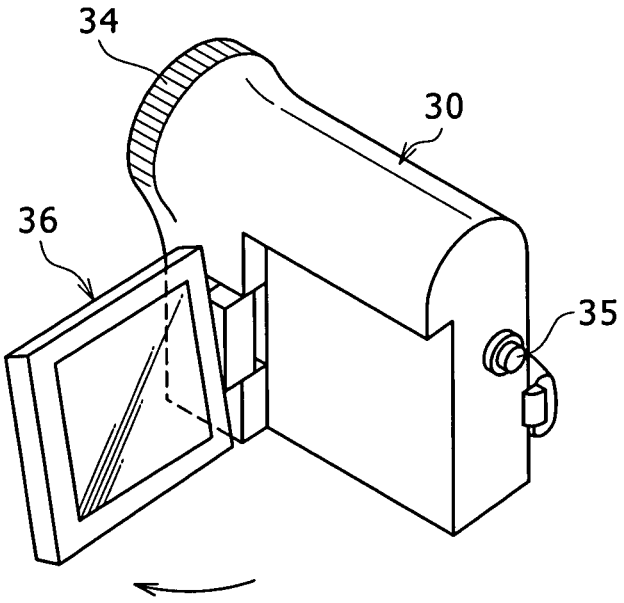
FIG. 23 is a perspective view of a video camera including a display device according to an embodiment of the present invention.

FIG. 23 shows a video camera to which the present embodiment is applied. The video camera includes a main unit 30, a lens 34 for taking a picture of a subject, which lens is situated on a side facing frontward, a start/stop switch 35 at the time of picture taking and a monitor 36. The video camera is fabricated using a display device according to an embodiment of the present invention as the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a source terminal of a switching transistor directly electrically connected to a terminal of an auxiliary capacitance and directly electrically connected to a terminal of a retaining capacitance;

a gate terminal of a drive transistor directly electrically connected to a drain terminal of a sampling transistor and directly electrically connected to another terminal of the retaining capacitance;

a power supply line directly electrically connected to a drain terminal of the switching transistor and directly electrically connected to another terminal of the auxiliary capacitance;

a source terminal of the drive transistor directly electrically connected to said source terminal of the switching transistor and directly electrically connected to said terminal of the retaining capacitance; and a drain terminal of the drive transistor directly electrically connected to an anode of a light emitting element.

2. The display device according to claim 1, wherein said switching transistor is controllable to provide electrical connection and disconnection between said power supply line and said terminal of the retaining capacitance.

3. The display device according to claim 1, wherein a cathode of the light emitting element is directly electrically connected to a grounding line.

4. The display device according to claim 1, wherein said drive transistor is controllable to provide electrical connection and disconnection between said anode of the light emitting element and said source terminal of the switching transistor.

5. The display device according to claim 1, wherein a source terminal of the sampling transistor is electrically connected to a signal line.

6. The display device according to claim 5, wherein said sampling transistor is controllable to provide electrical connection and disconnection between said signal line and said gate terminal of the drive transistor.

7. The display device according to claim 5, wherein said signal line intersects a drive scanning line and a write scanning line.

8. The display device according to claim 7, wherein a gate terminal of the sampling transistor is directly electrically connected to said write scanning line.

9. The display device according to claim 7, wherein a gate terminal of the switching transistor is directly electrically connected to said drive scanning line.

10. The display device according to claim 7, wherein a drive scanner is configured to output a drive signal pulse onto said drive scanning line during a time period (T1), said drive signal pulse controlling said switching transistor to electrically disconnect said source terminal of the drive transistor from said power supply line.

11. The display device according to claim 10, wherein an electrical connection is absent between said gate terminal of the drive transistor and said signal line during said time period (T1).

12. The display device according to claim 10, wherein said drive signal pulse controls said switching transistor to electrically connect said source terminal of the drive transistor to said power supply line after the time period (T1) but during a time period (T2).

13. The display device according to claim 12, wherein a power supply potential is on said power supply line during the time period (T2).

14. The display device according to claim 12, wherein a write scanner is configured to output a write signal pulse onto said write scanning line after the time period (T2) but during a time period (T3), said write signal pulse controlling said sampling transistor to electrically connect said gate terminal of the drive transistor to said signal line.

15. The display device according to claim 14, wherein a reference potential is on said signal line during the time period (T3).

16. The display device according to claim 14, wherein said write signal pulse controls said switching transistor to electrically disconnect said source terminal of the drive transistor from said power supply line after the time period (T3) but during a time period (T4).

17. The display device according to claim 16, wherein said reference potential is provided to said gate terminal of the drive transistor during the time period (T4).

18. The display device according to claim 16, wherein said write signal pulse controls said switching transistor to electrically disconnect said gate terminal of the drive transistor from said signal line after the time period (T4) but during a time period (T5).

19. A display device comprising:

a source terminal of a switching transistor directly electrically connected to a terminal of an auxiliary capacitance and directly electrically connected to a terminal of a retaining capacitance;

a gate terminal of a drive transistor directly electrically connected to a drain terminal of a sampling transistor and directly electrically connected to another terminal of the retaining capacitance;

a power supply line directly electrically connected to a drain terminal of the switching transistor and directly electrically connected to another terminal of the auxiliary capacitance;

a source terminal of the drive transistor directly electrically connected to said source terminal of the switching transistor and directly electrically connected to said terminal of the retaining capacitance;

a source terminal of the sampling transistor electrically connected to a signal line; and a gate terminal of the switching transistor directly electrically connected to a drive scanning line, wherein said signal line intersects said drive scanning line and a write scanning line.

* * * * *